US005605290A

United States Patent [19]

Brenholdt

[11] Patent Number: 5,605,290

[45] Date of Patent: Feb. 25, 1997

[54] APPARATUS AND METHOD FOR PARTICLE SIZE CLASSIFICATION AND MEASUREMENT OF THE NUMBER AND SEVERITY OF PARTICLE IMPACTS DURING COMMINUTION OF WOOD CHIPS, WOOD PULP AND OTHER MATERIALS

[75] Inventor: Irving R. Brenholdt, Stratford, Conn.

[73] Assignee: The Lektrox Company, New Port Richey, Fla.

[21] Appl. No.: 460,549

[22] Filed: Jun. 2, 1995

[51] Int. Cl.[6] ..... B02C 7/14

[52] U.S. Cl. ..... 241/21; 241/28; 241/37; 241/261.2

[58] Field of Search ..... 241/21, 27, 28, 241/33, 37, 261.2

[56] References Cited

U.S. PATENT DOCUMENTS

| | | | |
|---|---|---|---|
| 3,568,939 | 3/1971 | Brewster et al. | 241/28 |
| 3,604,646 | 9/1971 | Keyes, IV et al. | 241/37 |
| 4,073,442 | 2/1978 | Virving | 241/337 |
| 4,233,600 | 11/1980 | Rogers et al. | 241/37 X |
| 4,661,911 | 4/1987 | Ellery, Sr. | 241/37 X |
| 4,688,726 | 8/1987 | Brenholdt | 241/28 |
| 4,712,743 | 12/1987 | Nordin | 241/30 |
| 5,000,823 | 3/1991 | Lindahl | 241/28 X |
| 5,500,088 | 3/1996 | Allison et al. | 162/198 |

FOREIGN PATENT DOCUMENTS

| | | | |
|---|---|---|---|
| 8606770 | 11/1986 | WIPO | 241/37 |

OTHER PUBLICATIONS

U.S. Department of Energy, "Small Business Innovation Research, Abstracts of Phase II Awards 1993," DOE/ER-0600, p. 44.

U.S. Department of Energy, "Office of Industrial Technologies Research in Progress,"DOE/OSTI-11633/4 (DE93011440), May, 1993, p. 52.

X. Qian, et al., "A Mechanistic Model for Predicting Pulp Properties from Refiner Operating Conditions," *Tappi Journal,* vol. 78, No. 4, Apr., 1995, pp. 215–222.

The Joint Textbook Committee of the Paper Industry, "Mill-Wide Process Control & Information Systems," *Pulp and Paper Manufacture,* Third Edition, vol. 10, Copyright 1993, pp. 167–169.

*Primary Examiner*—John M. Husar
*Attorney, Agent, or Firm*—Barry R. Lipsitz

[57] ABSTRACT

An apparatus and method are provided in which direct ohmic connection is made to a comminution device (e.g., a wood chip or pulp refiner) to obtain transient voltages, existing on the refining elements, that are directly related to fiber impacts. These voltages are characterized by severity (S) (i.e., magnitude), rate (N), rise time (RT) and polarity (±P). The characteristics of these voltages taken separately and/or in mathematical combinations predict the properties of refined wood chips and pulps, i.e., freeness, tensile strength, tear, burst, breaking length and fiber length. Signal characteristics further track refiner plate wear and detect the occurrence of "critical gap" as well as the onset of plate clash.

24 Claims, 33 Drawing Sheets

| BAND PASS NUMBER | MEAN RISE TIME μ SEC | MEAN AREA μ m | (ASSUMED RADIUS = 12 μm) MEAN LENGTH μ m | |
|---|---|---|---|---|
| 1 | 50.00 | 377,704 | 5000.0 | |
| 2 | 28.57 | 215,820 | 2857.0 | |
| 3 | 16.32 | 123,319 | 1632.4 | |
| 4 | 9.32 | 70,464 | 932.8 | |
| 5 | 5.33 | 40,263 | 533.0 | |
| 6 | 3.04 | 23,006 | 404.5 | |
| 7 | 1.74 | 13,145 | 174.0 | |
| 8 | .99 | 7,511 | 99.4 | |
| 9 | .56 | 4,292 | 56.8 | |
| 10 | .32 | 2,452 | 32.4 | FINES |
| 11 | .18 | 1,401 | 18.5 | |
| 12 | .10 | 800 | 10.6 | |
| 13 | .06 | 457 | 6.0 | |

COMBINED

FIG. 9A

IMPACT SENSOR

IMPACT RATE ANALYZER

NET IMPACT POTENTIAL ANALYZER

APPARATUS AND METHOD FOR PARTICLE SIZE CLASSIFICATION AND MEASUREMENT OF THE NUMBER AND SEVERITY OF PARTICLE IMPACTS DURING COMMINUTION OF WOOD CHIPS, WOOD PULP AND OTHER MATERIALS

TECHNICAL FIELD

The invention relates to process measurement and control and, more particularly, to comminution (i.e., the breaking up or grinding into small fragments) of wood chips, wood pulp and other materials.

BACKGROUND OF THE INVENTION

In the pulp and paper industry, chip refining and pulp refining are two widely used processes that contribute significantly to the industry's energy costs. At the same time, these processes have a great impact on the factors of efficiency, productivity and end product quality. Improvement of each of these factors will naturally directly influence a producer's competitiveness.

There are two types of refining processes in use. Both types prepare the fibers for paper making. The processes change the fiber structure and paper making characteristics. The fiber walls are disrupted so that the fiber can collapse and become flexible. Also, fibrils in the fiber wall are freed to extend outward and engage with other fibers in the formed paper web. Some fibers are shortened in the refining process.

Pulp refiners take, as an input, pulp fibers in suspension after the fibers have been separated from each other in some prior process. One such prior process is chemical pulping.

Thermomechanical pulpers (TMP) have wood chips as an input. These refiners perform both the fiber separation process as well as preparing the fibers for subsequent processes.

In the U.S., the total annual energy consumption for pulp refining and chip refining are on the order of $180\times10^{12}$ and $44\times10^{12}$ BTU/yr, respectively. In a workshop entitled "Pulp And Paper Mill of the Future," sponsored by the U.S. Department of Energy in 1993, industry experts identified a number of critical technologies needed to improve energy efficiency, process efficiency, and waste reduction in the paper industry. In the area of refining, the technologies mentioned were advanced process control models based on fundamental studies, sensors to permit feedback control for power input, water and wood flow rates and angular velocity. In addition, it was noted that sensors to rate the quality of recycled raw materials would greatly facilitate the expanded use of this material.

A prevalent method of refiner control is through "specific energy," defined as horsepower days per ton (HPD/T). This control parameter is indicative of energy expended per unit material processed and is an approximate predictor of resultant pulp quality but is, of course, dependent upon efficiency. Another specific energy relationship is $E=N\times S$, which has been known only in a theoretical way, where N represents the number of fiber impacts per unit time and S represents the severity (magnitude) of the impacts.

Previous attempts to measure both N and S independently, or to derive them from known parameters, have failed.

SUMMARY OF THE INVENTION

An object of the invention is to measure fiber impacts per unit time and the severity of such impacts.

In accordance with a first aspect of the invention, a system is provided for utilizing electrical currents derived from the rupture (impacts) of an electrical double layer surrounding particles in suspension during a comminution or refining process.

In accordance with a second aspect of the invention a refining element may be connected to an isolation transformer which provides a broadband, zero common mode input to a differential amplifier and line driver in order to form an impact sensor.

According to a third aspect of the invention, N and S are measured and classified according to a unique characteristic (i.e., rise time) of the observed signal. The N and S values are then usable in the above-mentioned specific energy relationship as a precise predictor of pulp quality.

In accordance with a fourth aspect of the invention, impact voltages derived from the currents generated by particle impacts are separated on the basis of rise time and analyzed to produce impact rates (N1, N2) and impact severities (S1, S2).

Further in accordance with the fourth aspect of the invention, a potential (±P) is derived from the algebraic sum of the rms positive impacts and the rms negative impacts. This potential relates to the slurry net charge.

In still further accord with the fourth aspect of the invention, N1, N2, S1, S2, P1 and P2 and various ratios, products and sums thereof correspond directly to various parameters of pulp quality as well as the efficiency of the comminution or refining process.

Traditionally, the quality of the end product, paper, is predicted by collecting pulp samples and performing a series of tedious laboratory tests for tensile strength index (N·m/g), tear index ($mN\cdot m^2/g$), burst index ($kPa\cdot m^2/g$), breaking length, fiber length, and electrical (Zeta) potential of the "furnish" (i.e., water, fiber and other constituents as well known in the art).

This invention also fills the need for a sensor which can measure the direct effect of the refining process separate from the energy consumption parameter, in real time and on line, in order to provide optimum control for both energy efficiency and pulp quality.

Apparatus in accordance with the present invention determines at least one parameter of a material undergoing comminution in a comminution device. First coupling means provide an ohmic connection to a first comminution surface of the comminution device. Second coupling means provide an ohmic connection to a second comminution surface of the comminution device. Means are coupled to the first and second coupling means for receiving an electrical signal caused by impacts of particles in suspension undergoing comminution between the first and second comminution elements. The receiving means provide an output signal indicative of at least one of the number of impacts and impact potential of the particles. As used herein, the term "impact potential" is defined as the average value of the impacts of different polarity. In a preferred embodiment, the output signal is also indicative to the magnitude (i.e., severity) of the impacts.

The receiving means can provide symmetrical common-mode isolation and discrimination of the electrical signal. In this manner, the output signal is derived from primary current only and not common-mode voltages.

The common-mode isolation and discrimination can be provided by an isolation transformer having primary windings coupled to said first and second coupling means and secondary windings coupled to a difference amplifier. A voltage-controlled amplifier is coupled to amplify an output of the difference amplifier. A line driver is coupled to receive the amplified output from the amplifier to provide the output signal.

A spectrum divider can be provided. The spectrum divider is responsive to the output signal for providing a plurality of channel output signals each indicative of the number and magnitude of a different group of said impacts. The groups are segregated according to rise time. For example, where two channel output signals are desired, the spectrum divider can comprise a low pass filter for outputting one of the channel output signals and a high pass filter for outputting the other of the channel output signals. The spectrum divider can provide a substantially one-to-one relationship of impact magnitudes in the plurality of channel output signals.

The apparatus can further comprise first spectrum analyzer means, responsive to a first one of the channel output signals, for providing a first impact rate signal and a first impact severity signal. Second spectrum analyzer means, responsive to a second one of the channel output signals, provide a second impact rate signal and a second impact severity signal. Signal processor means are also provided. The signal processor means are responsive to the first and second impact rate signals and to the first and second impact severity signals. The signal processing means process selected impact rate and severity signals to provide at least one combined signal. A controller, responsive to the at least one combined signal, is provided to control the comminution device and/or to provide information (e.g., quality measurements) relative to the product being produced.

The at least one combined signal can include a combined signal indicative of a sum or quotient of the first and second severity signals. A combined signal can also be included that is indicative of a sum or quotient of the first and second impact rate signals. A combined signal can further be provided which is indicative of a product of one of the impact signals and a corresponding severity signal.

The first spectrum analyzer means can be responsive to the first channel output signal for also providing a first net impact potential signal. The second spectrum analyzer means can be responsive to the second channel output signal for providing a second net impact potential signal. In such an embodiment, the signal processor means are responsive to the first and second net impact potential signals to produce at least one combined signal indicative of the sum or quotient of the first and second net impact potential signals.

The apparatus can further comprise means responsive to the plurality of channel output signals and to a fiber radius signal indicative of the radius of fibers of the material under comminution, for providing a fiber length signal indicative of the length of the fibers for each of the channel output signals. A controller is coupled to the fiber length signal for each of the channel output signals to control the comminution device and/or provide information about the product being produced.

A method is provided for determining at least one parameter of a material undergoing comminution in a comminution device. First and second comminution elements of the comminution device are sensed to provide an electrical signal indicative of occurrences of impacts of the material undergoing comminution. The electrical signal is processed to provide an output signal indicative of at least one of the number of impacts and impact potential of the material undergoing comminution. The output signal is processed in real time to predict at least one property of the material as it is undergoing comminution.

In response to the output signal, a plurality of channel output signals can be provided. Each of the channel output signals is indicative of a group of the impacts segregated according to rise time. The method can comprise the further steps of analyzing the channel output signals to provide corresponding analyzed signals. The analyzed signals are processed mathematically to provide at least one combined signal. A control signal can be produced in response to the combined signal for controlling the comminution device.

The method can comprise the further steps of providing a fiber length signal for each of the channel output signals. The fiber length signal is indicative of the length of the fibers and is provided in response to the channel output signals and a fiber radius signal indicative of the radius of the fibers of the material undergoing comminution. A control signal can be provided for controlling the comminution device in response to the fiber length signals.

In accordance with the method of the invention, the output signal can be used to predict at least one of freeness, tensile strength, tear, burst, breaking length and fiber length of the material undergoing comminution, e.g., in a wood chip or pulp refiner. The output signal can also be used to predict at least one of critical gap and the onset of plate clash in the comminution device.

These and other objects, features and advantages of the present invention will become more apparent in light of the detailed description of a best mode embodiment thereof, as illustrated in the accompanying drawings.

BRIEF DESCRIPTION OF THE DRAWINGS

FIG. 1A shows a comminution device comprising two comminution surfaces, one of which is a rotating disc;

FIG. 1B shows a comminution device with two surfaces comprising two counter-rotating discs;

FIG. 1C shows a comminution device having two surfaces, one of which is a rotating frustum;

FIG. 1D shows a comminution device comprising four or more surfaces, one of which is a rotating drum;

FIG. 1E shows a comminution device having four surfaces, one of which is a single rotating disc;

FIG. 1F shows a comminution device having two surfaces, one of which is a rotating drum; and FIG. 1G shows a comminution device having two surfaces, one of which is a reciprocating member.

FIGS. 3A–3C together show a simplified illustration of the mechanism of a signal source which is a first aspect of the invention, wherein:

FIG. 3A shows a particle in a comminution device before impact showing the particle/electric double layer/water interface;

FIG. 3B shows a metal/particle (in shear)/metal interface during impact in the comminution device, wherein the diffuse electrical layer of FIG. 3A is ruptured by comminution; and FIG. 3C shows a water/electric double layer/particles interface after impact in the comminution device.

FIGS. 9A and 9B show in tabular and graphical form, respectively, an extension of the spectrum division aspect of the invention to provide a classification of wood fibers during the process of refining.

FIGS. 16–26 show, without limitation, how material properties can be predicted, according to the invention, wherein:

FIG. 16 shows a relationship between sensor output and both freeness and couch vacuum;

FIG. 17 shows both tear index and tensile index plotted against impact sensor output and illustrate important and recognized properties of the refined pulp, sometimes called "handsheet properties";

FIG. 18 shows that the parameter N1 increases as both flow rate and rotational speed decrease;

FIG. 19 shows impact sensor output vs. weighted average length on one axis and arithmetic average length on the other axis;

FIG. 21 shows that the ratio of S1/S2 is a property of the pulp. In separate trials, one at constant pulp flow rate and the other at variable flow rate, the same value of S1/S2 is obtained when the specific energy, HPD/T, and flow rate are identical;

FIG. 22 shows that the parameter S1/S2 is a property of the pulp developed jointly by two refiners operating in series and that when a critical gap is reached in a refiner, the S1/S2 parameter and the pulp quality which it predicts are diminished;

FIG. 23 is indicative of plate clash and indicates how the parameters S1/S2 and P indicate the occurrence of a critical plate gap;

FIGS. 24 and 25 demonstrate the impact sensor's capability to detect changes in the quality of refiner feed stock, wherein:

FIG. 24 shows the simultaneous response of two refiners processing the same feed stock, indicating that the sensor responds to the quality of the feed stock;

FIG. 25 shows a case where the wood quality has been intentionally altered, and proves that the ratio of S1/S2 is a good indicator of wood quality;

FIG. 26 illustrates data taken from a valley beater, which shows that the integral of N*S is an excellent predictor of pulp response to refining with respect to a representative example of pulp quality, e.g., tensile strength;

DETAILED DESCRIPTION OF THE INVENTION

FIGS. 1A–1G show various examples of comminution devices, each example showing an ohmic coupling to both a radial bearing or bearings and a fixed or adjustable stator. The following reference letters have the meaning indicated consistently throughout FIGS. 1A–1G: (A) thrust bearing; (B) radial bearing; (C) rotor; (D) stator; (E) reciprocator; (F) gap; (G) sensor ohmic coupling; (H) brush contact; and (f) force.

Figure 1A:
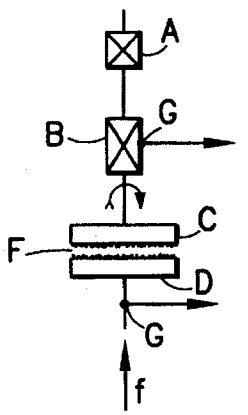
FIGS. 1A–1G show seven examples of comminution devices with connections, according to the invention, to facilitate sensor operation for each device; in particular.

FIG. 1A shows a single rotating disc (C) with a fixed disc stator (D) to which an ohmic contact (G) is made. A second ohmic contact (G) is made to a radial bearing (B).

Figure 1B:
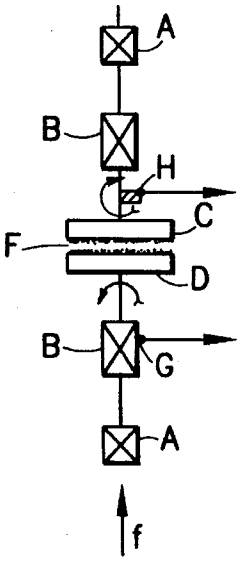

FIG. 1B shows a comminution apparatus comprising two counter-rotating discs (C) with one of the sensor contacts being made at a radial bearing and the other by means of a brush contact (H).

Figure 1C:
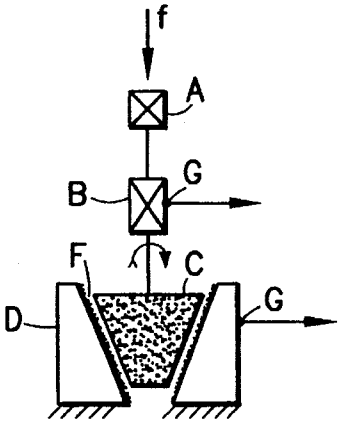

FIG. 1C shows a comminution apparatus comprising a single rotating frustum of right circular cone interfaced to a stationary stator (D). In this case, one of the sensor ohmic couplings is made to the stator and the other to a radial bearing (B).

Figure 1D:
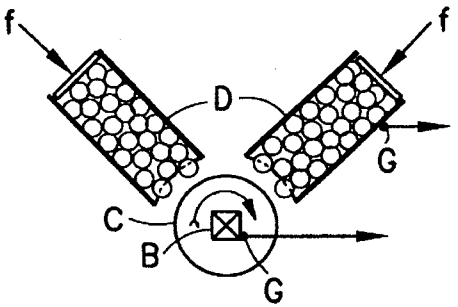

FIG. 1D shows a rotor comprising a single rotating drum (C) interfaced to four or more surfaces of metallic spheres packed into cylindrical stator (D) cartridges. The ohmic contacts in this case are shown on one of the cartridges and on a radial bearing (B).

Figure 1E:
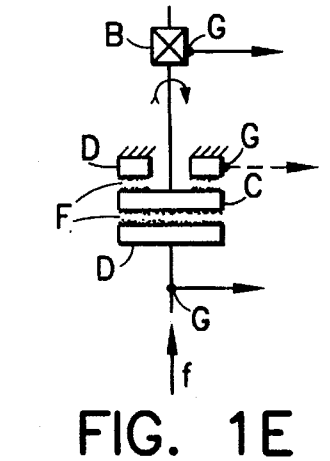

FIG. 1E shows a comminution device comprising a single rotating disc (C) adjacent a stationary disc (D), wherein the electrical contacts for the sensor are made at the stator (D)

and at a radial bearing (B) of a shaft of the rotor (C). An additional ohmic contact is shown on an additional stator part on an opposite side of the rotating disc (C) from the first-mentioned stator. An ohmic contact may be made here as well, as shown.

Figure 1F:
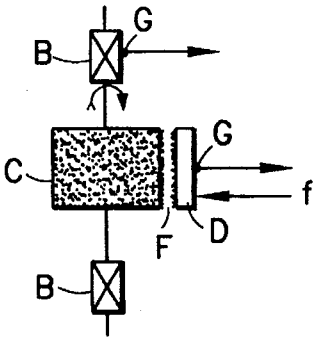

FIG. 1F shows a comminution apparatus having a single rotating drum (C) adjacent a stator (D) having an ohmic contact (G). A second ohmic contact is made on a radial bearing (B), as 'shown.

Figure 1G:
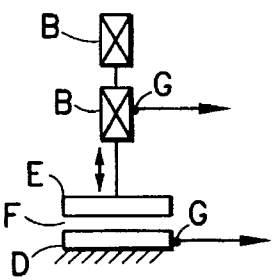

FIG. 1G shows a comminution apparatus comprising a single reciprocating member (E) adjacent a stationary surface of a stator (D) having an ohmic contact (G). The second electrical connection for the sensor is made at a radial bearing (B).

It should be realized that the foregoing examples of comminution devices are not exhaustive, and many other variations are possible. FIGS. 1A–1G will thus be understood to represent mere illustrative examples of comminution devices which can be used to advantage with the present invention.

Figure 2:
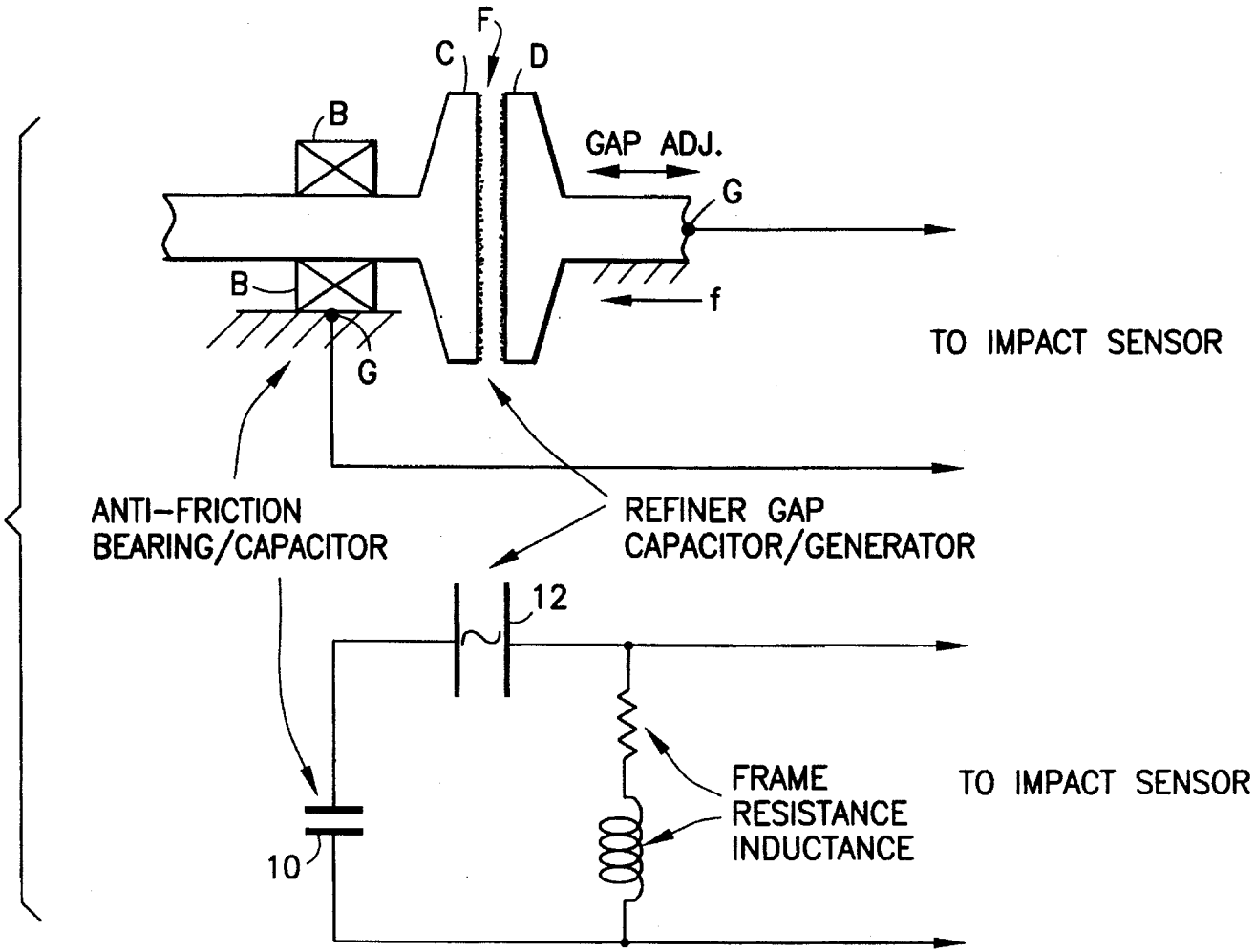
FIG. 2 illustrates, according to the invention, the electrical equivalent of a single rotating disc refiner such as shown in FIG. 1A.

Referring to the comminution devices of FIGS. 1A–1G and to a comminution device shown in FIG. 2, two ohmic connections (G) are made to each of the comminution devices. The first connection, an "active" connection, is made to the axially positionable member of said device either directly or, in some cases via an electrical brush assembly. The second connection, the reference connection, is made to a frame of the comminution device, e.g., to an anti-friction bearing housing of the non-positionable member. Other connections are possible.

The comminution device of FIG. 2 is similar to that shown in FIG. 1A and is also shown with an electrical equivalent circuit in the lower portion of the figure. The anti-friction bearing (B) has its analog in a capacitor 10, the gap (F) has its analog in a capacitor/generator 12 in parallel with the resistance/inductance of the frame of the comminution device. The capacitor/generator 12 of FIG. 2 will be explained in more detail in connection with FIG. 3B below. It should be noted that the equivalent circuit of FIG. 2 is for a single rotating disc refiner/comminution device, and that the equivalent circuit will differ depending on the type of device modeled. This equivalent circuit is believed to be correct and is proffered as an explanation along with FIGS. 3A–3C of the observed phenomena that have led to the invention. However, it should be realized that there may be other explanations for the underlying physical process. In any event, it has been demonstrated by extensive testing that the means and methods disclosed and claimed for taking advantage of the discovered phenomena work very well.

Figure 3A:
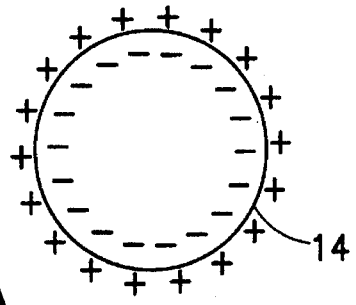
Figure 3B:
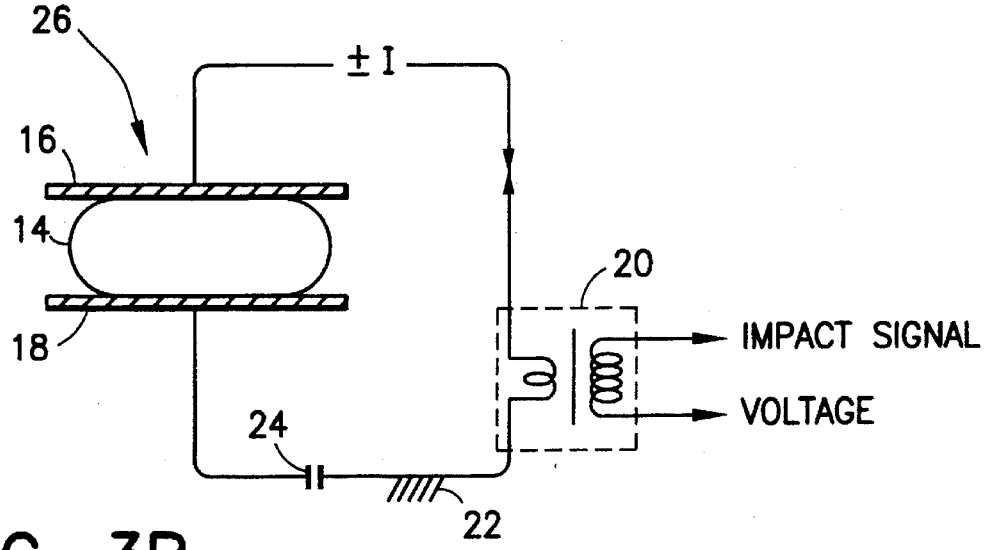
Figure 3C:
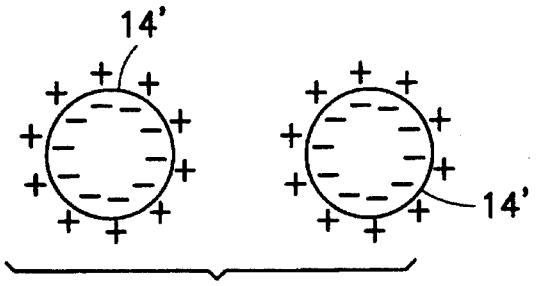

Referring to FIGS. 3A–3C, a "signal source" first aspect of the invention is illustrated. Although various theories have been put forth to account for the origin of the electric charges acquired by dissimilar phases in contact (particles in suspension), the oldest hypothesis by Helmholtz-Lamb at the turn of the century is useful in explaining the present invention. As shown in FIG. 3A, the phase having the highest dielectric constant (in this case water) becomes positive relative to the particle which becomes negative. Consequently, a double layer of charge exists around each particle, as shown. Stern, in 1924, further depicted the double layer to be a charged capacitor, one side of which is the solid surface having attached to it a rigid layer of approximately molecular thickness, and beyond this a diffuse layer extending into the liquid. Part of the electric charge is concentrated in the surface, while the density of that in the liquid diminishes asymptotically to zero. The total potential fall in the two layers is called the epsilon potential $\epsilon$, that in the diffuse layer is called the zeta potential $\zeta$.

To proceed with the description of the first aspect of the invention, referring again to FIG. 3A, i.e., before impact of a particle in the comminution device, the particle 14 is shown surrounded by an electric double layer suspended in water. The zeta potential $\zeta$ equals $$\frac{4\pi e\delta}{\epsilon},$$

where e is the electron charge per unit area, $\delta$ is the distance between two sides of the double layer and $\epsilon$ is the total or epsilon potential. A simplified electrical equivalent of the above is:

$$C=\frac{AK}{d}\ ;\ Q=EC$$

where C is capacitance, A surface area, K dielectric constant, d distance between effective surfaces, Q charge and E electromotive force.

During impact within the comminution device 26, as shown in FIG. 3B, the particle 14 is in shear between two metal electrically conductive comminution elements 16, 18. The electrical double layer is ruptured and in the process, a current pulse flows from one comminution element through the impact sensor 20 to the frame of the comminution device 22. To complete the circuit, the current pulse flows through the lubricated bearing 24 (a large capacitance) to the rotating comminution element 18 of the comminution device. Upon rupture, the distance $\zeta$ becomes zero, and therefore both the zeta potential and epsilon potential become zero. In the process, the current I illustrated in FIG. 3B equals $$\frac{\pm E}{R}\ e^{-t/RC}$$

where C is the equivalent capacitance of the charged particle. R is resistance, t is time, l is base of natural logarithm and E is electromotive force. (In practice, the signal voltage E is ±5 to ±15 millivolts peak to peak.)

After impact, as shown in FIG. 3C, the particle(s) 14' is(are) again suspended in water. The shape and texture of the particle has been altered and the particle might be broken into more than one part, including extremely small parts (fines). As shown, the electrical double layers are restored.

Figure 4:
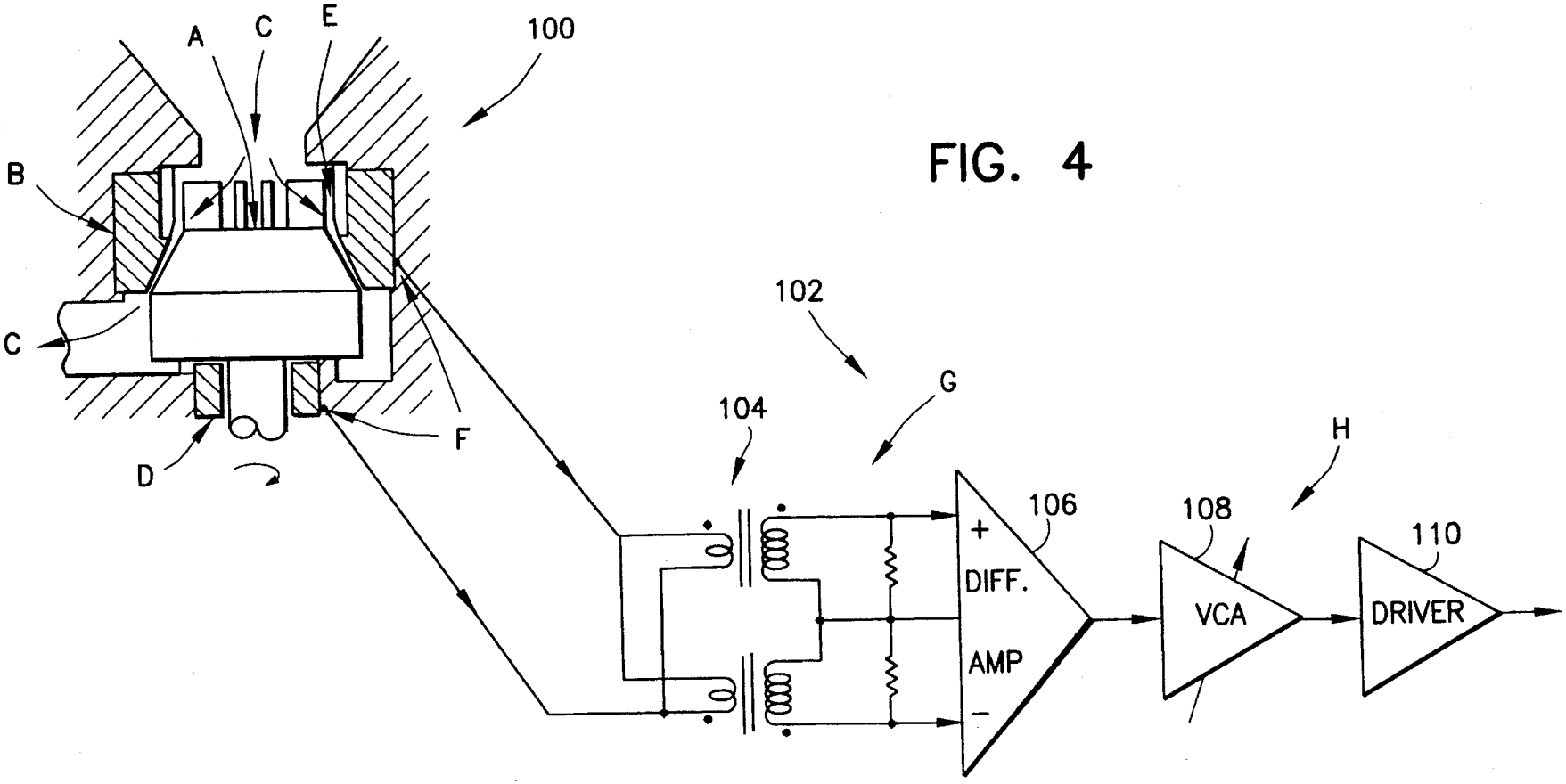
FIG. 4 is a diagram of the impact sensor connected to a comminution device which is the second aspect of the invention.

FIG. 4 shows a comminution device 100 in the form of one type of colloid mill, (Eppenbach-Gifford-Wood). In the illustration, a serrated rotor (A) and a serrated stator (B) provide mechanical shear and force the material into an adjustable gap (E), e.g., 0.125 inches to 0.0005 inches between the rotor and stator. A hydrosol or slurry (C) passes the material. Anti-friction bearings (D) are shown in association with the serrated rotor (A) for holding the rotor in position for maintaining the proper gap (E) between the rotor and stator. Ohmic couplings (F) are shown connected to a symmetrical common-mode isolator and discriminator (G), which is in turn connected to an amplifier and line driver (H). The symmetrical common-mode isolator and discriminator (G), together with the amplifier and line driver (H), forman impact sensor generally designated 102, according to the second aspect of the invention.

Broadband pulse transformers 104 are connected, as shown, in pairs to provide symmetrical common-mode isolation and discrimination. Thus, any signal at the input of the differential amplifier 106 is the result of primary current only, not common-mode voltages. Typical input/output impedance of the isolation transformer is 6 ohm/200 ohm. A voltage controlled amplifier (VCA) 108 and line driver 110 are provided, as shown. The line from driver 110 to the remaining parts of the apparatus may typically be 150 ft to 200 ft of 75 ohm cable. Amplitude of the impact sensor output to the line is typically 3 volts rms.

Figure 5A:
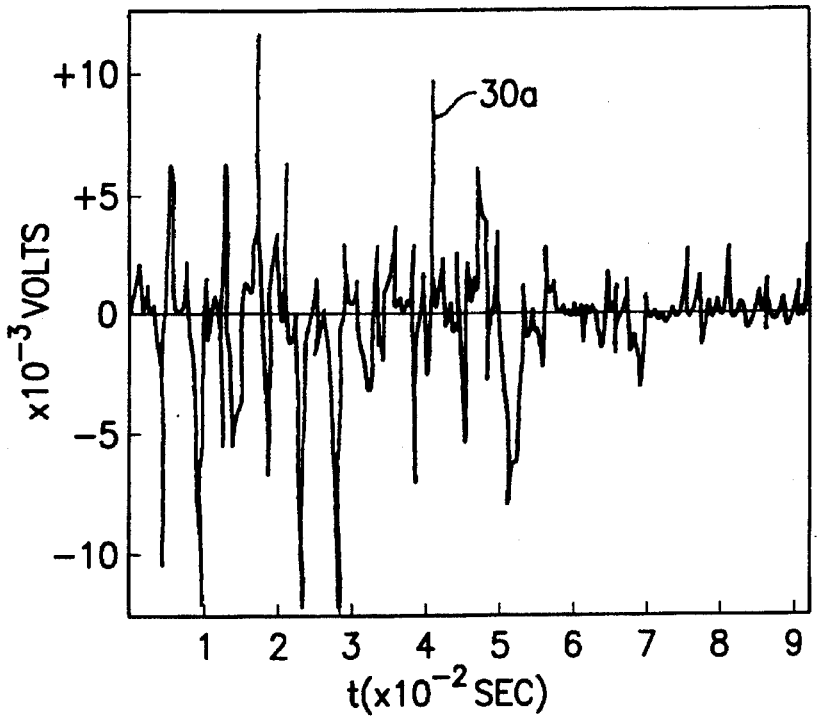
FIGS. 5A and 5B show typical electro-kinetic potentials sensed from comminution devices, according to the invention.
Figure 5B:
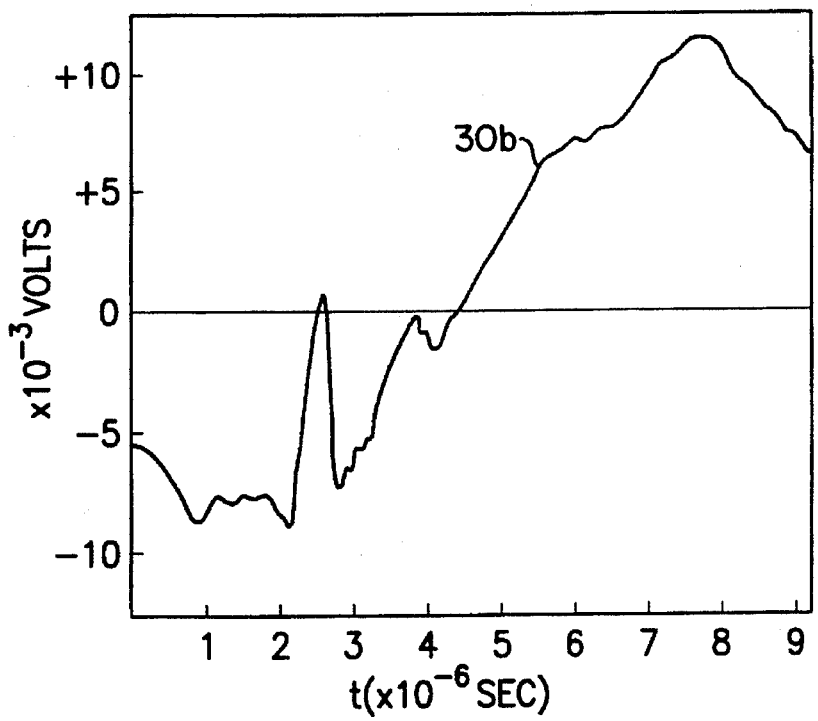

FIGS. 5A and 5B show typical electro-kinetic potentials 30*a*, 30*b* derived from comminution devices. These potentials exist across the input to the pulse transformers 104 of FIG. 4. Rise time of the impact pulses may typically vary between 30 and 0.3 microseconds.

Figure 6:
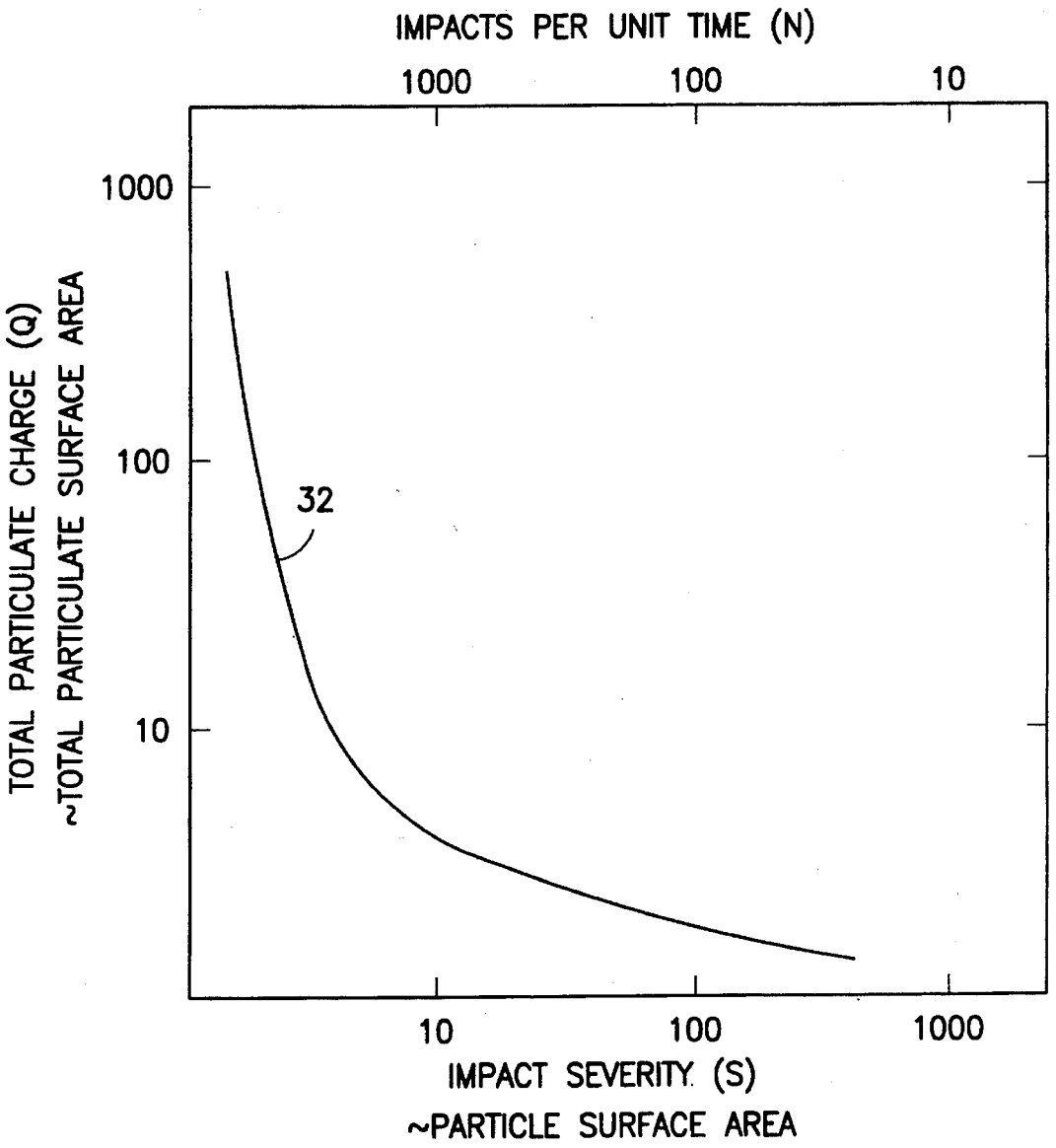
FIG. 6 is a graph showing a relationship between impact severity (S), impact rate (N), surface area, and total charge (Q), according to the invention.

FIG. 6 provides a curve 32 representing a comminution process involving refining of wood fibers. The data was obtained by initially recording analog sensor data with a digital recorder. Subsequently, data was played back several times. Each time the number of impacts was summed for levels of severity above a specific magnitude. The data indicates that the surface area and total particulate charge (Q) is derived from the smallest particles.

Figure 7A:
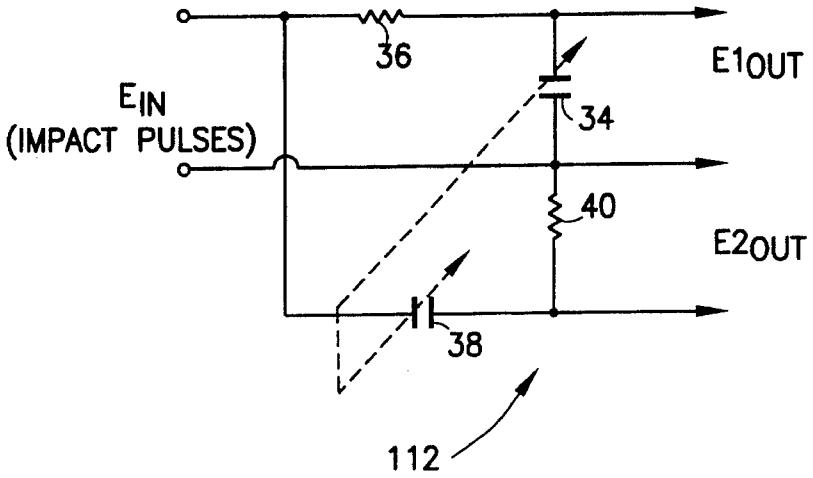
FIG. 7A illustrates a rise time spectrum divider according to the third aspect of the invention.
Figure 7B:
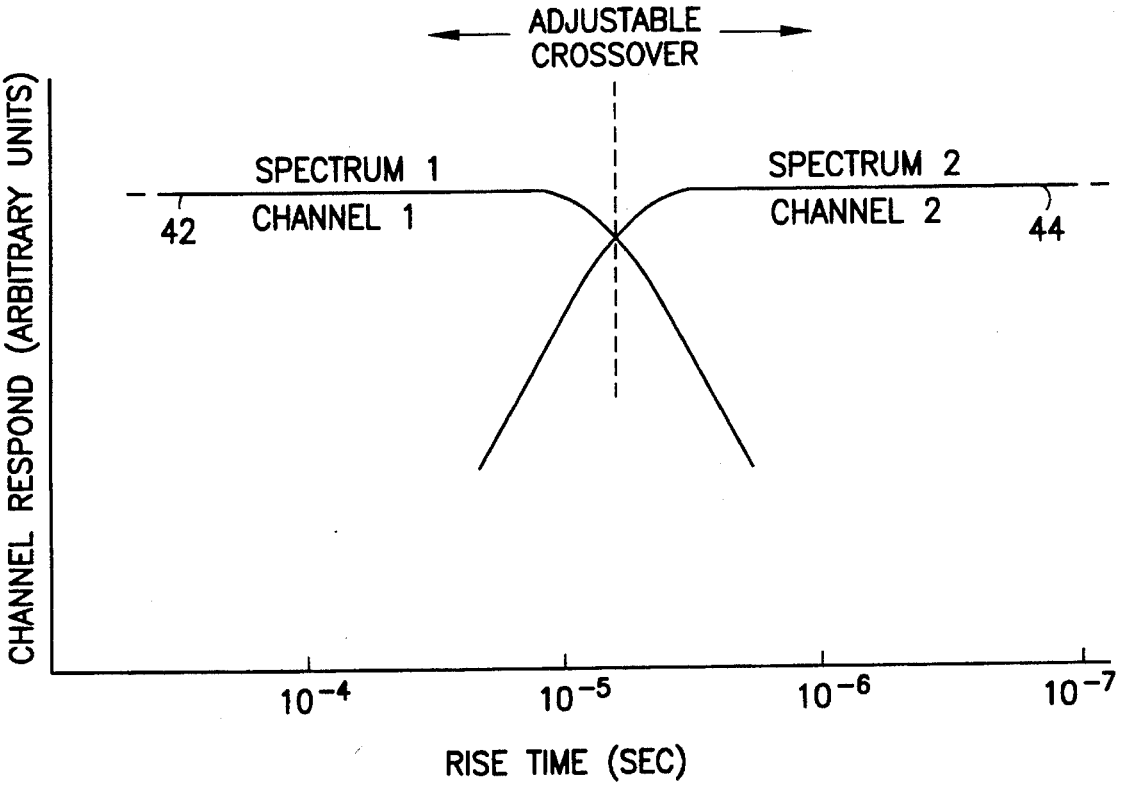
FIG. 7B illustrates channel response, together illustrating a principle of rise time spectrum division and crossover, further to the third aspect of the invention.

FIGS. 7A and 7B together show the spectrum division aspect of the invention and show how the spectrum of rise time is divided. Application of this aspect of the invention has proven that ratios of larger particles to smaller particles during the comminution process in terms of impact rate N and impact severity S can be directly correlated with product (e.g., pulp and paper) quality parameters.

The rise time spectrum is split into two components by a low pass filter formed from capacitor 34 and resistor 36 and a high pass filter formed by capacitor 38 and resistor 40, together providing the rise time spectrum divider 112 of FIG. 7A. Both filters can be adjusted simultaneously up or down the spectrum via variable capacitors 34 and 38, providing an adjustable crossover. The preferred adjustment or calibration provides a near one-to-one relationship of severity S, between a first spectrum 42 and a second spectrum 44 illustrated in FIG. 7B. This calibration will be different for comminution devices of different design. Once a setting has been determined for the crossover point of a given device, it should not be changed. It should be noted that a fixed capacitor and variable resistor is effectively equal, and can be substituted for the implementation illustrated.

Figure 7C:
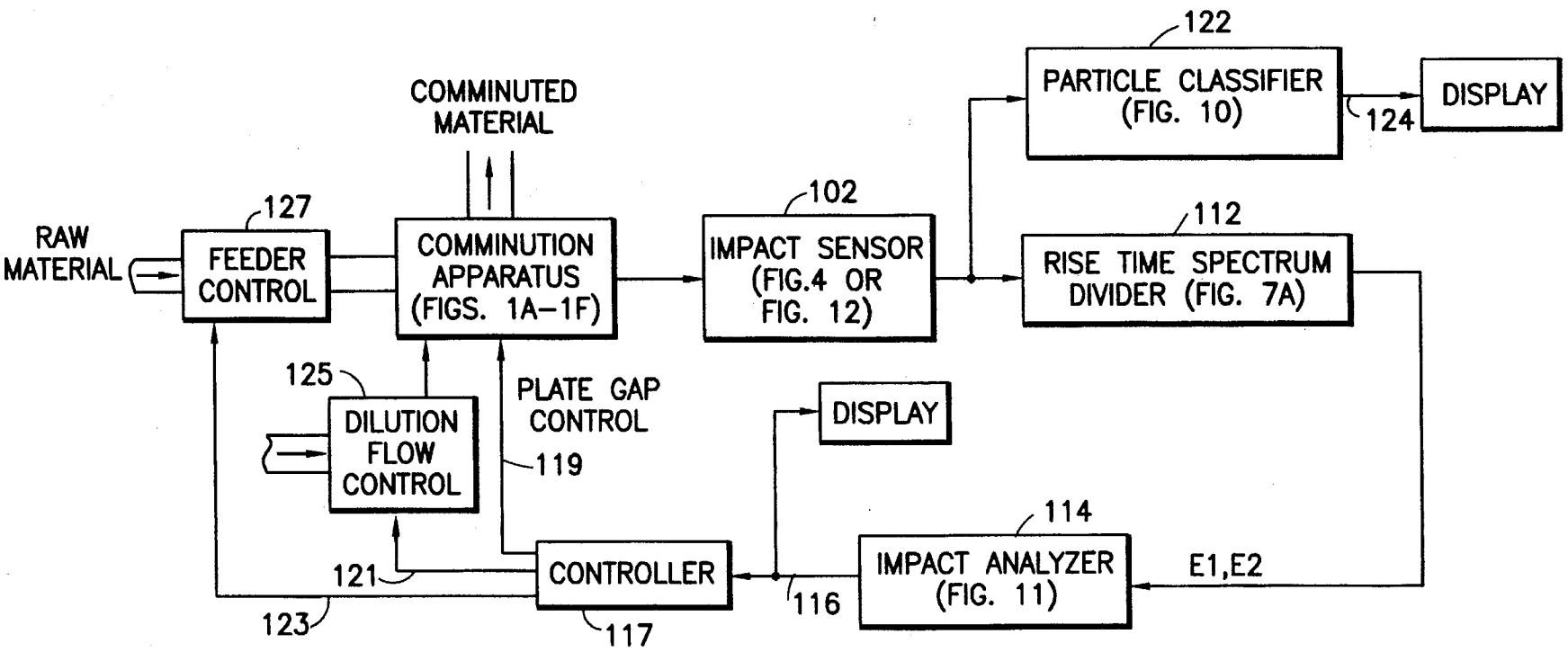
FIG. 7C shows the impact sensor of FIG. 4 (or of FIG. 12) connected to the rise time spectrum divider of FIG. 7A, which is in turn shown connected to the impact analyzer of FIG. 11, to be described below, for controlling the comminution device of FIG. 4 and/or for providing information concerning the product under comminution.

FIG. 7C shows the rise time spectrum divider 112 of FIG. 7A fed by an impact sensor 102 such as already shown in FIG. 4 or such as to be described subsequently in connection with FIG. 12. The output of the rise time spectrum divider 112 is shown provided to an impact analyzer 114 to be described subsequently in connection with FIG. 11. It includes impact rate, impact severity and net impact potential signal processors and includes means for providing additional signal processing for relating the impact rates, impact severities and impact potentials found in the two input spectra from the rise time spectrum divider 112. It may also interface via line 116 with a controller 117 for executing a selected comminution control strategy algorithm. The controller, in turn, provides output control signals on lines 119, 121 and 123, as shown in FIG. 7C, for controlling comminution according to the selected comminution control strategy. Line 119 carries a plate gap control signal directly to the comminution apparatus. Line 121 carries a dilution flow control signal to a flow control valve 125 for controlling the flow of dilution water to the comminution apparatus. Line 123 carries a feeder control signal to a feeder control valve which controls the flow of raw material to the comminution apparatus.

Figure 8:
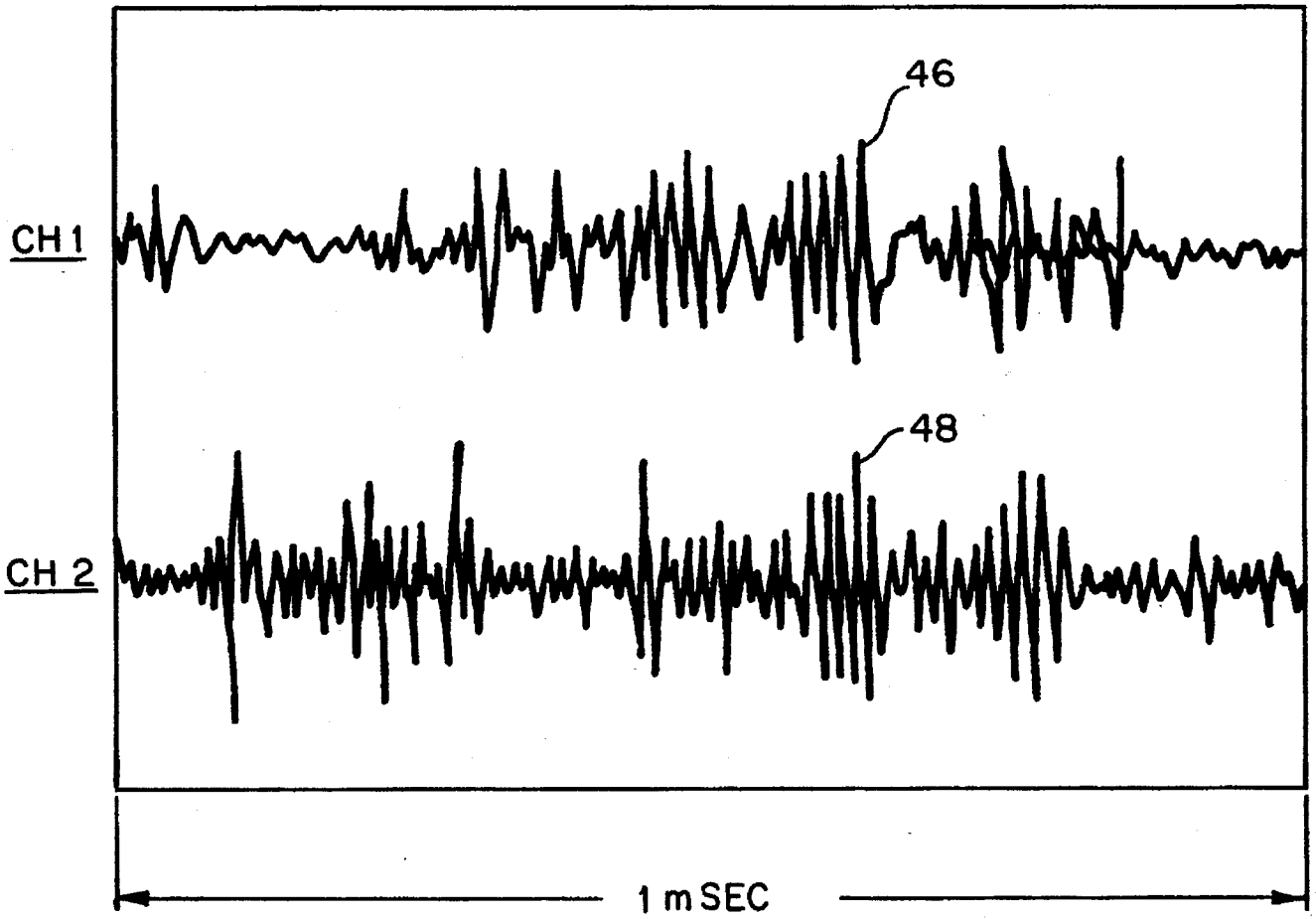
FIG. 8 is an example of signals obtained from two channel spectrum division, according to FIG. 7A.

Referring back to the spectrum division aspect of the invention, FIG. 8 represents oscilloscope traces 46, 48 of two channels derived from a valley beater with crossover at rise time (R.T.)=11 μsec. Note the slower rise times and fewer impacts of channel 1 as compared to channel 2. As described below, ratios of two such channels are useful for refiner control.

Figure 9B:
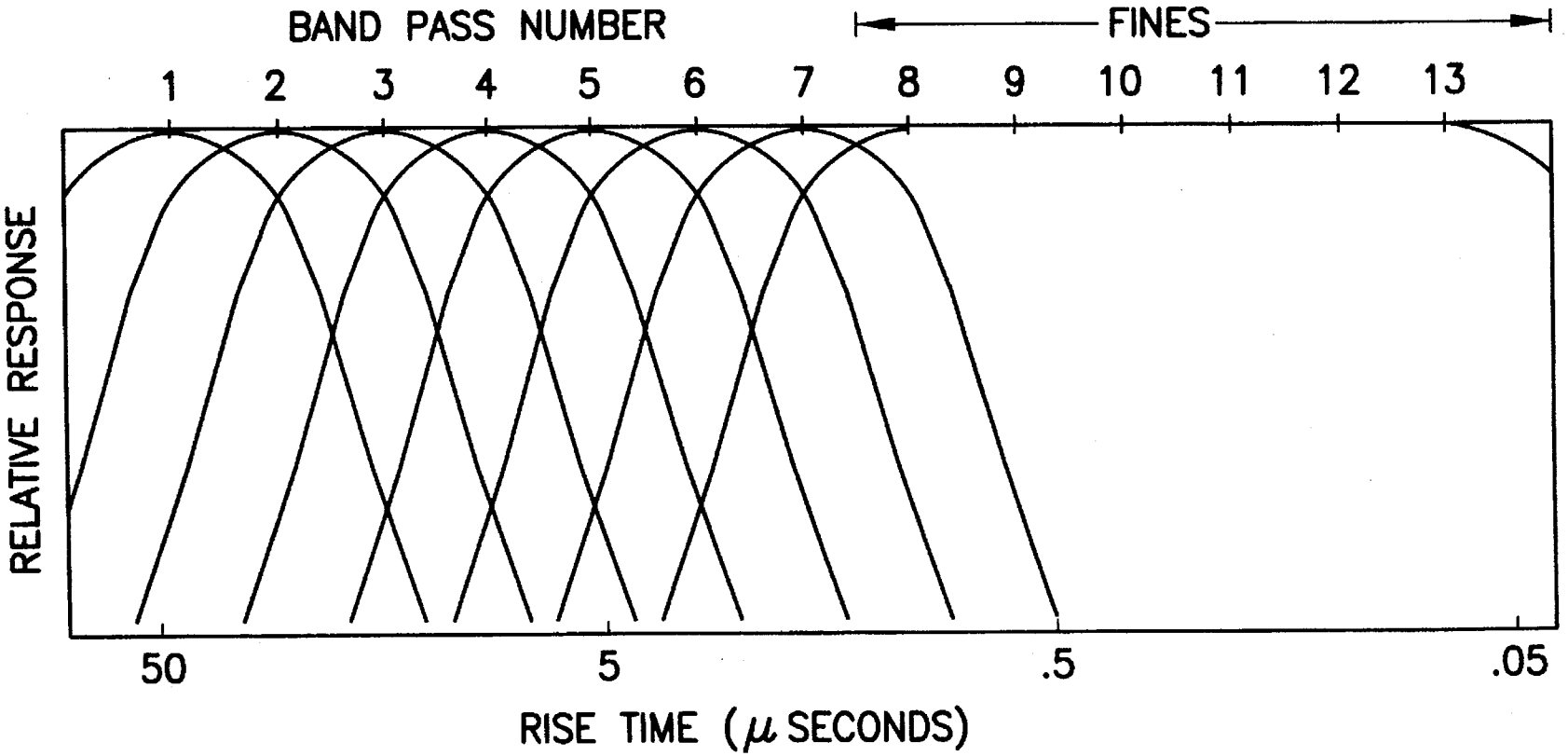

There are conditions under which it would be desirable to extend the concept of spectrum division to include several channels to provide real time spectrum classification of wood fibers or even for control purposes. Such an extended classification concept is shown in tabular form in FIG. 9A and in graphic form in FIG. 9B. Seven equal width pass bands are shown. An eighth broad band includes only those particles smaller than a predetermined size usually referred to as "fines". Assuming an average particle radius of 12 μm, the total spectrum shown includes particles from 6 μm to 5,000 μm, and rise times of 0.05 μs to 50 μs.

Figure 10:
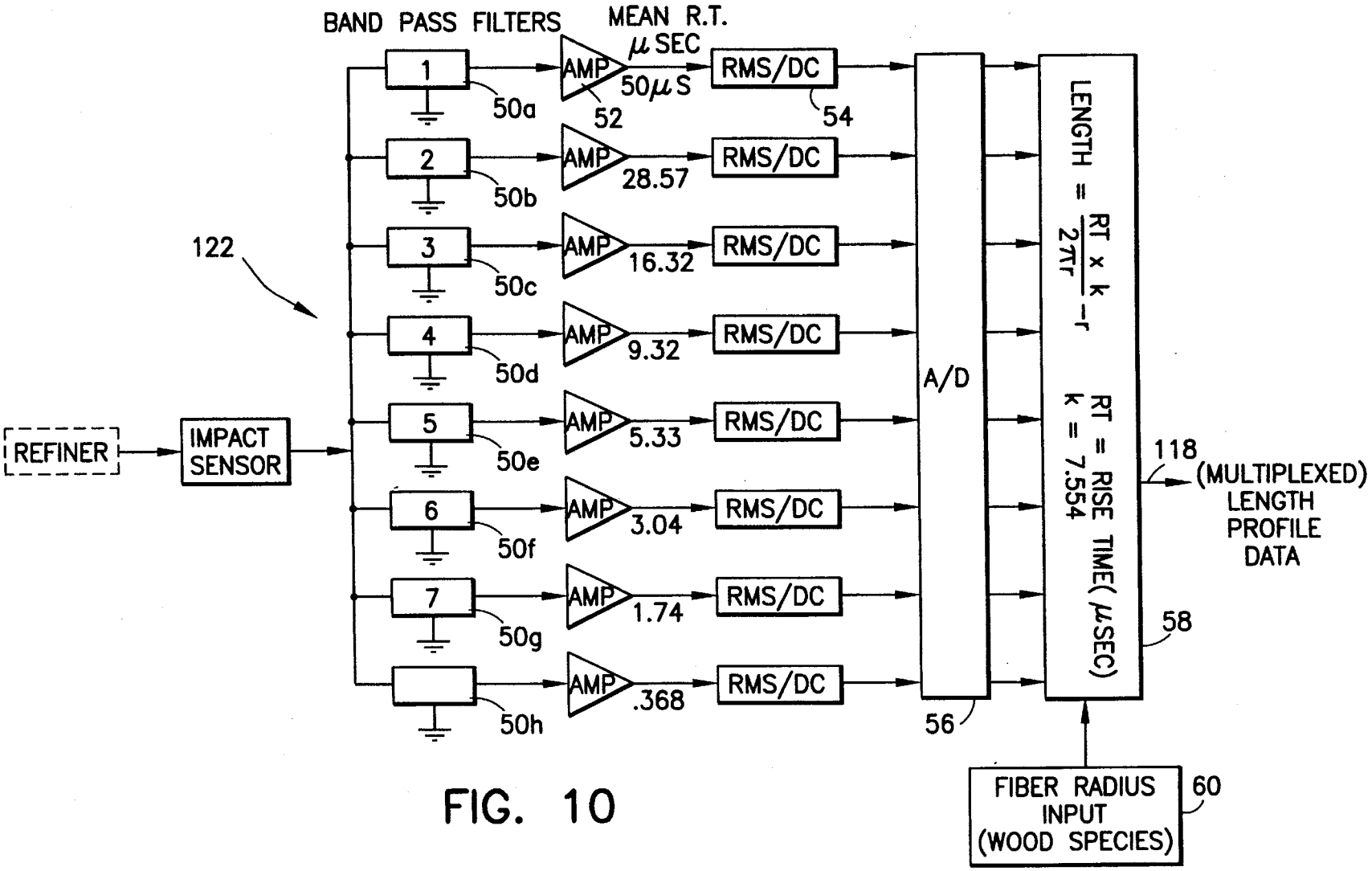
FIG. 10 is a functional diagram of a particle classifier according to the extension of the spectrum division aspect of the invention described in connection with FIGS. 9A and 9B.

FIG. 10 shows how a particle classifier as described may be constructed. Seven different bandpass filters 50*a*–50*g* are provided for the first seven bands of FIG. 9A and a single filter 50*h* is provided for the combined bands 8–13, followed by amplifiers 52, rms to DC converters 54, an analog-to-digital converter 56 and a calculator 58 that is responsive to the impacts in the different bands and an input fiber radius parameter 60 for providing length profile data. This may be multiplexed onto a single output line 118 if desired, as shown.

Figure 11:
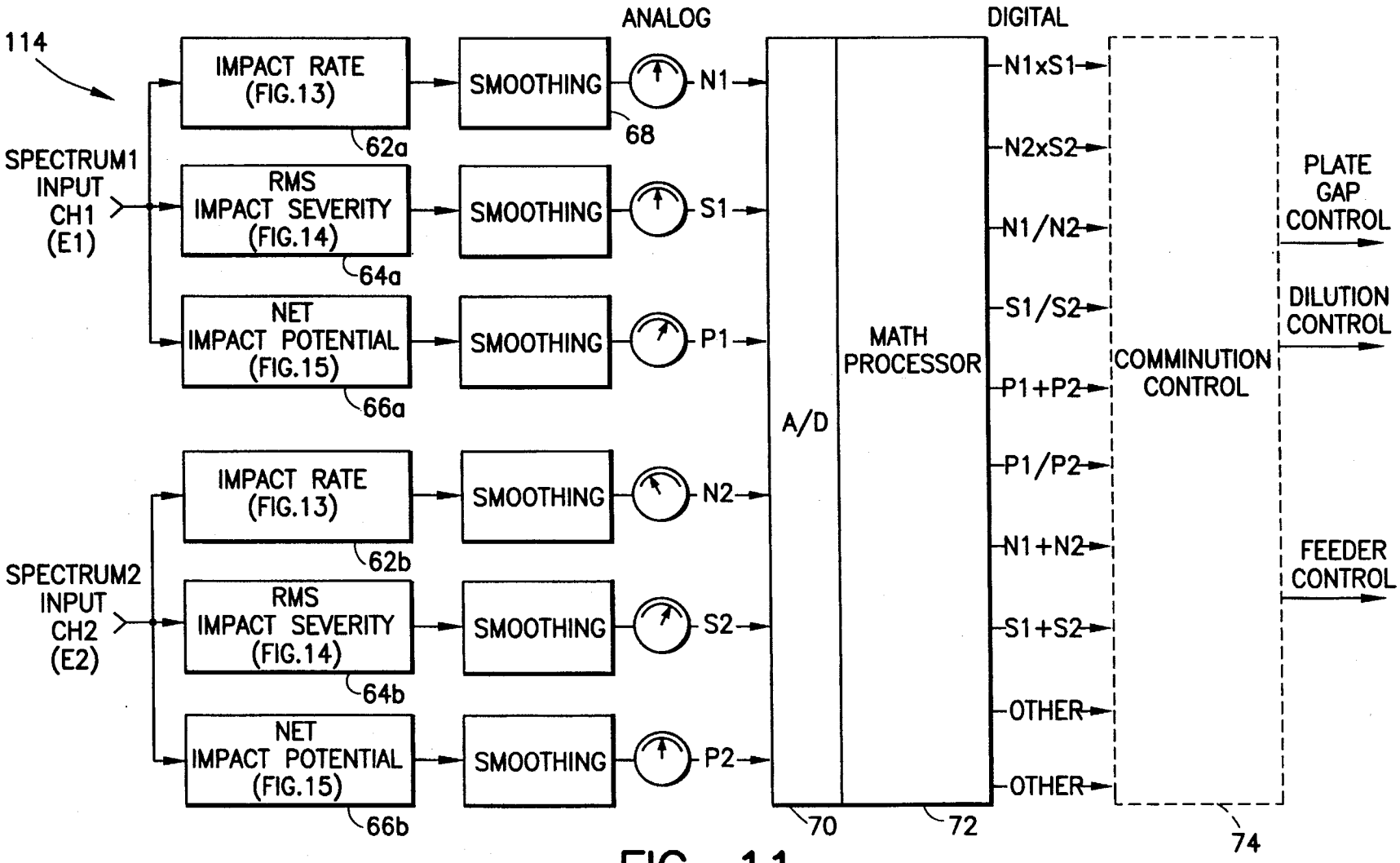
FIG. 11 is a functional diagram of an impact analyzer, a fourth aspect of the invention.
Figure 12:
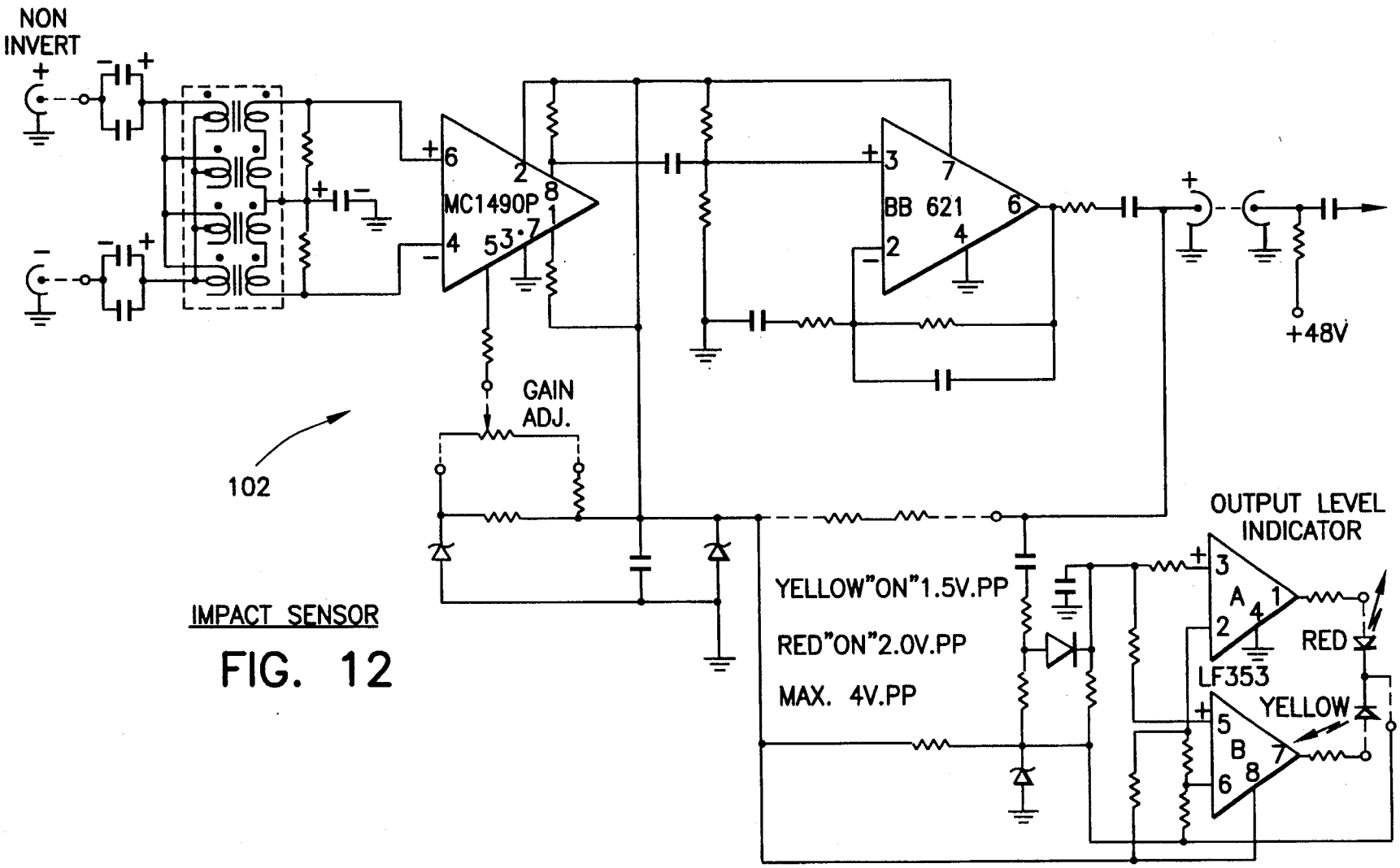
FIG. 12 is a schematic diagram showing the construction of an impact sensor, according to the second aspect of the invention.

FIG. 11 is a functional diagram of an impact analyzer 114 which is the fourth aspect of the invention. FIG. 11 shows channel one and channel two inputs (E1, E2) representing two separate spectra to be processed by separate channel impact rate processors 62*a*, *b* as shown in more detail in FIG. 13, separate rms impact severity processors 64*a*, *b* as shown in more detail in FIG. 14, and separate net impact potential processors 66*a*, *b* as shown in more detail in FIG. 15.

Figure 13:
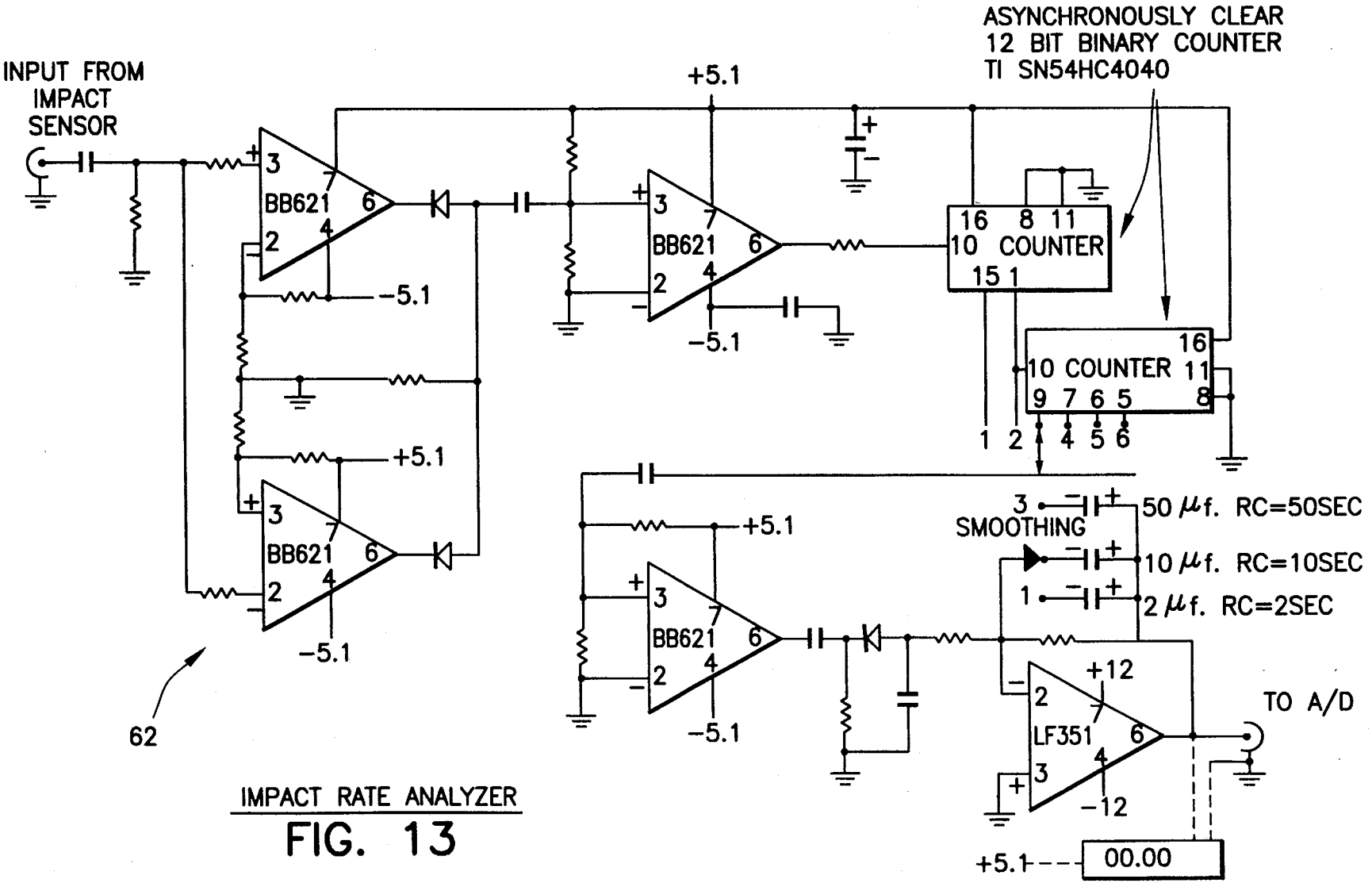
FIG. 13 is a schematic diagram showing the construction of an impact rate analyzer, according to the fourth aspect of the invention.

Impact rate, as processed in FIG. 13, is based on counting positive and negative impacts great and small per unit time, i.e., independent of impact severity. The resultant varying DC voltage is the analog of impact rate. A smoothing filter 68 can be provided at each processor, as shown in FIG. 11.

Figure 14:
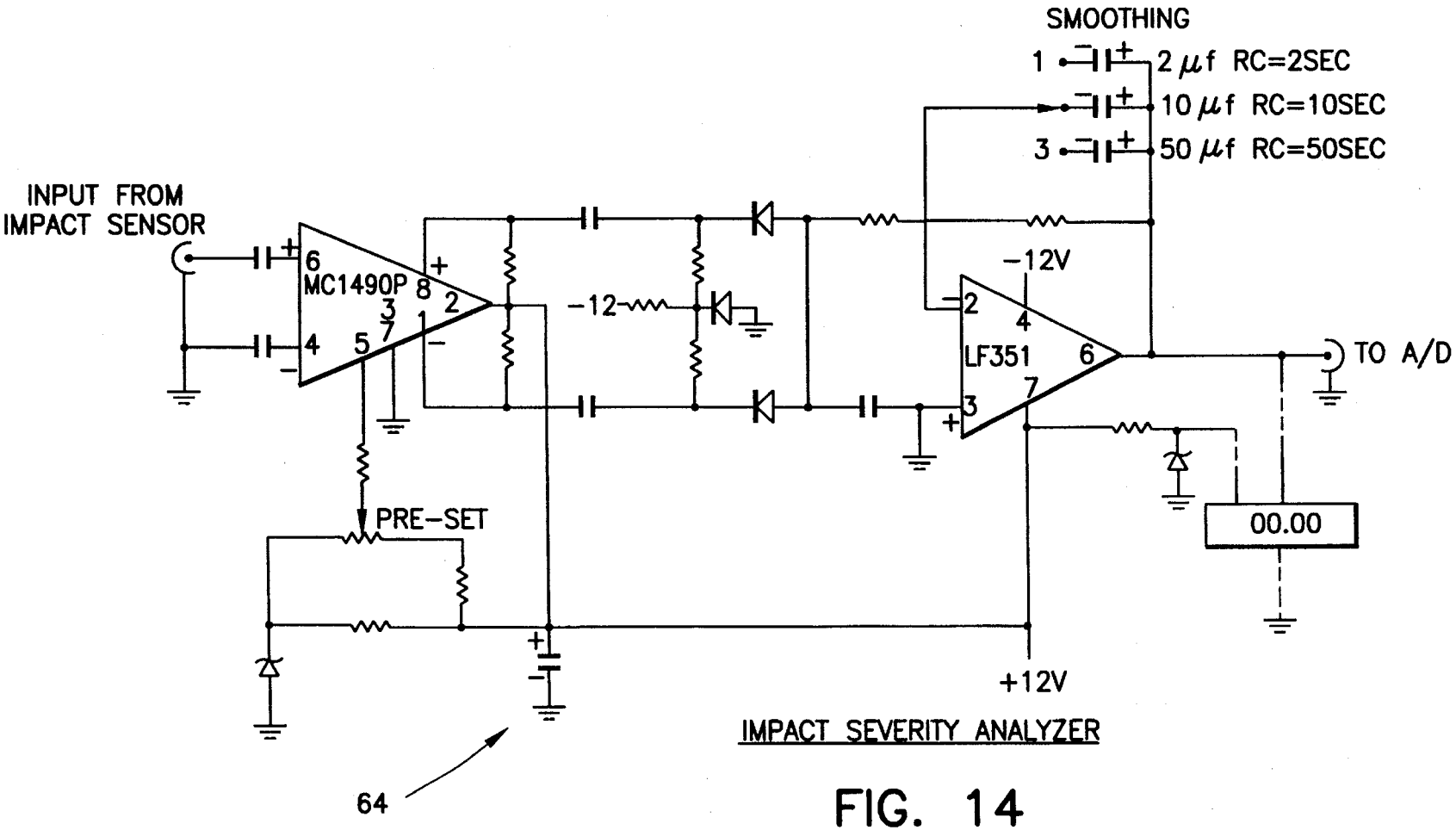
FIG. 14 is a schematic diagram showing the construction of an impact severity analyzer, according to the fourth aspect of the invention.

The impact severity processor of FIG. 14 is based on summing the energy of positive and negative pulses, including very small ones. The resultant DC voltage, which is the analog of severity, can be averaged over selected units of time by the smoothing filter as shown in FIG. 11.

Figure 15:
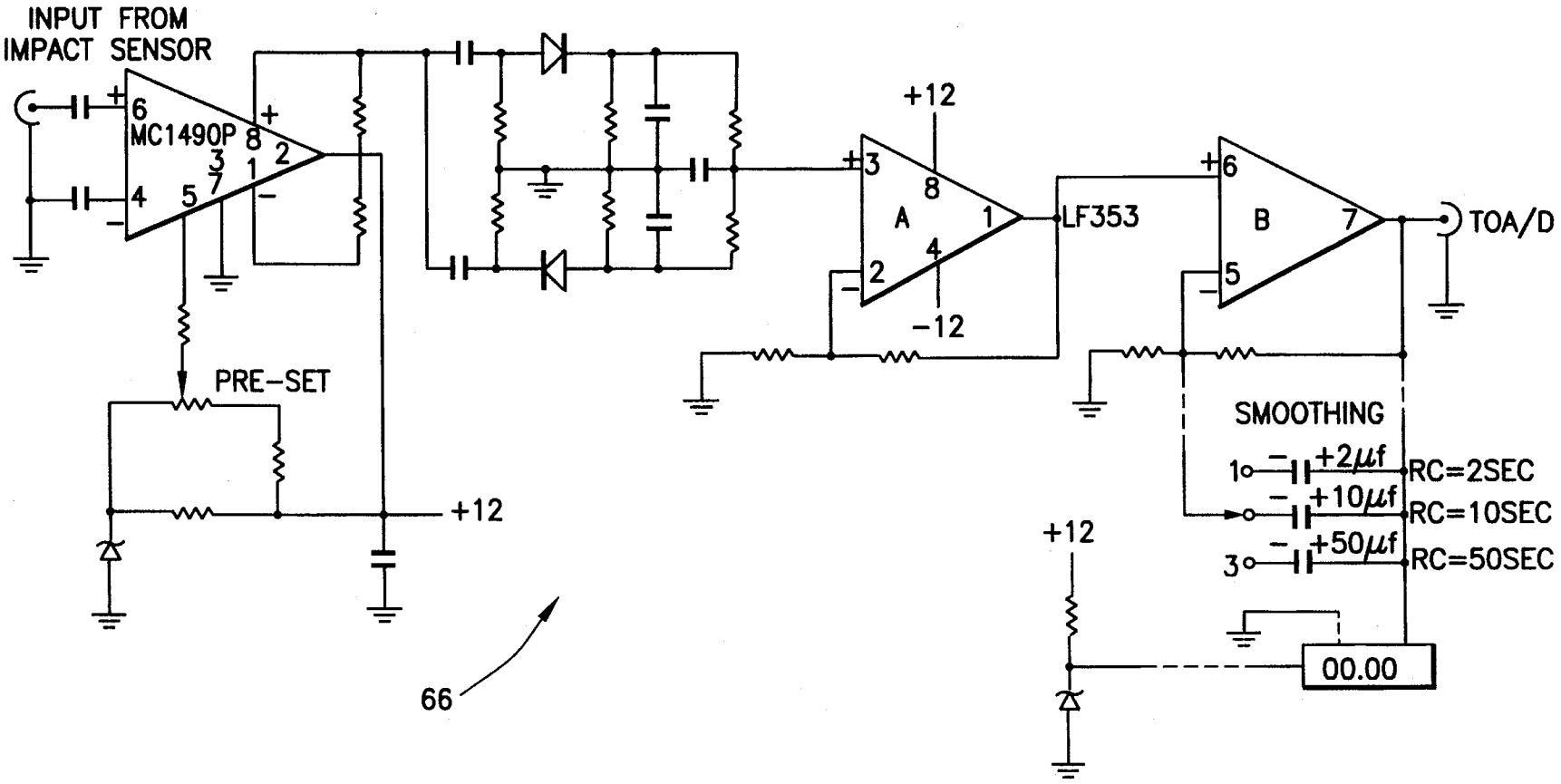
FIG. 15 is a schematic diagram showing the construction of an impact net potential analyzer, according to the fourth aspect of the invention.

Net impact potential, as determined by the processor of FIG. 15, is based on the fact that the severity of positive and negative pulses are not equal if averaged over time. Further, the net potential is the averaged degree of asymmetry of impact pulses. Asymmetry is caused by a difference in DC potential on the refining plates as a result of the comminution process.

As shown in FIG. 11, after smoothing, the resultant analog signals N1, S1, P1, N2, S2 and P2 can be converted to digital form by an analog-to-digital converter 70. Next, the following mathematical operations can be performed in a "mathematical operations" signal processor 72: N1·S1, N2·S2, N1/N2, S1/S2, P1+P2, P1/P2, N1+N2 and S1+S2. The products N1·S1 and N2·S2 can be used to predict specific energy, as indicated above.

These combinations are examples only and can be used to predict other properties of the refined wood chips and pulp as well, such as freeness, tensile strength, tear, burst, breaking length and fiber length. Control of the comminution process in response to these properties is effected by a comminution controller 74 which outputs, e.g., plate gap, dilution and feeder control signals.

Figure 16:
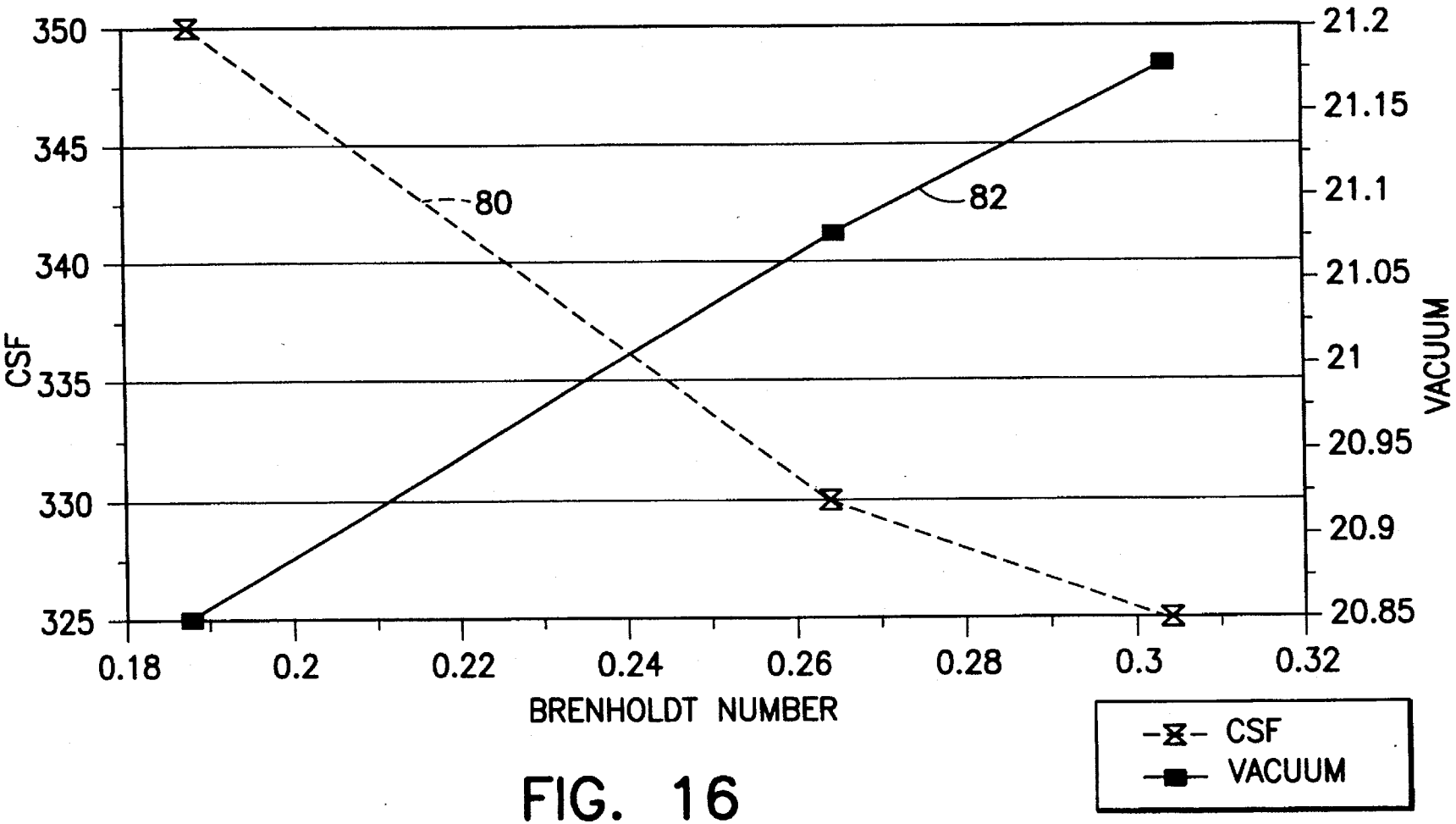

For instance, FIG. 16 shows the relationship between sensor output (Brenholdt number) and both freeness 80

(Canadian standard freeness, mL) and couch vacuum 82. Couch vacuum is a measurement on the paper machine which is inversely related to freeness.

Figure 17:
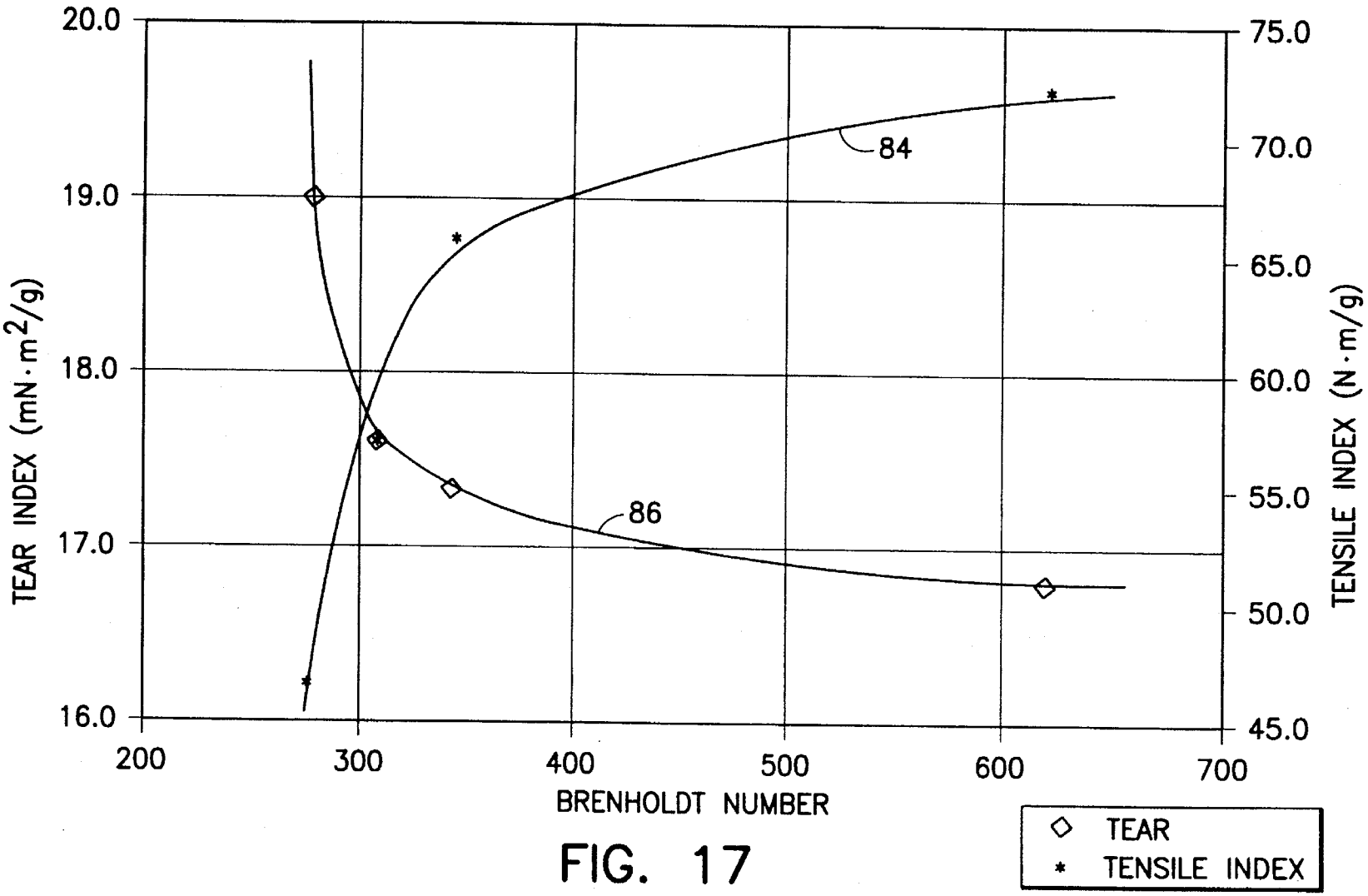

FIG. 17 shows both tear index 84 and tensile index 86 plotted against Brenholdt number (sensor output) and illustrate important and recognized properties of the refined pulp.

Figure 18:
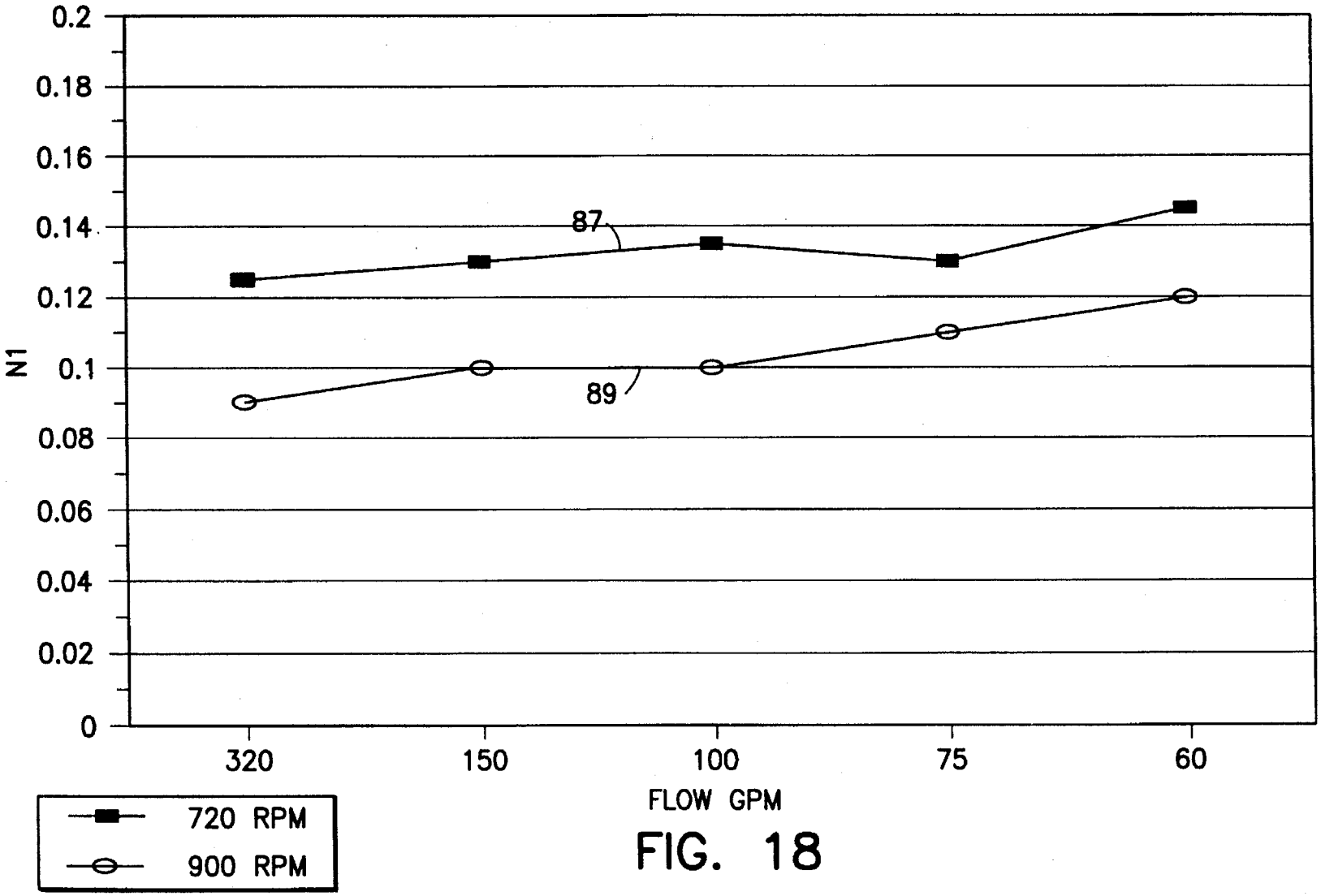

FIG. 18 shows that the number of impacts, N1, is related to both the flow rate and refiner rotational speed in accordance with theory based on residence time considerations. These paired data points were recorded at the same nominal value of HPD/T. A flow rate of 720 RPM is represented by curve 87 and a flow rate of 900 RPM is represented by curve 89. It can be seen that the traditional control parameter of HPD/T does not accurately reflect the effects of residence time.

Figure 19:
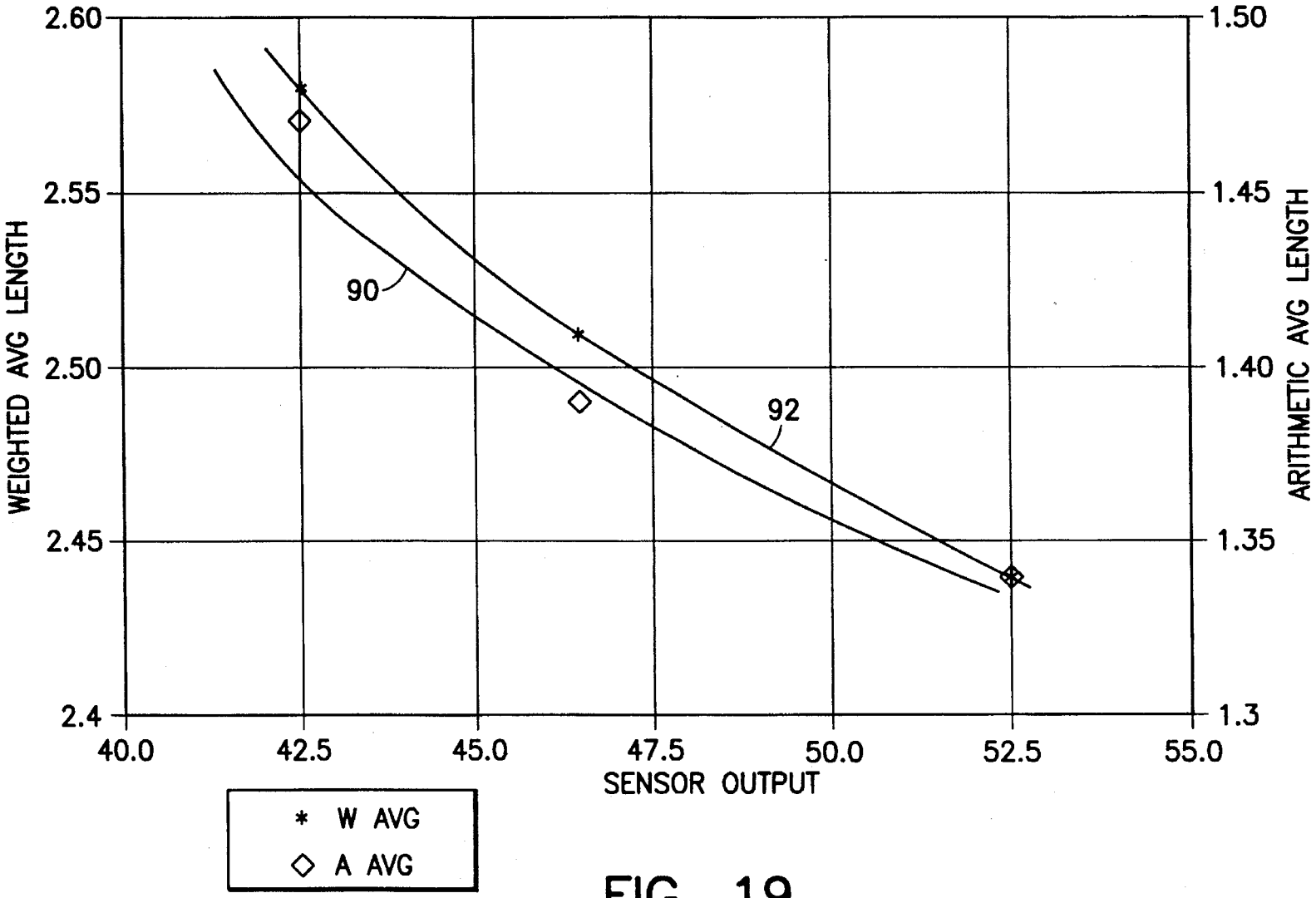

FIG. 19 shows sensor output vs. length weighted average 90 (on the left axis) and arithmetic average length 92 (on the right axis). These are important paper-making properties of the refined pulp, and the ability of the sensor output to indicate these properties will facilitate the automatic control of the comminution process.

Figure 20A:
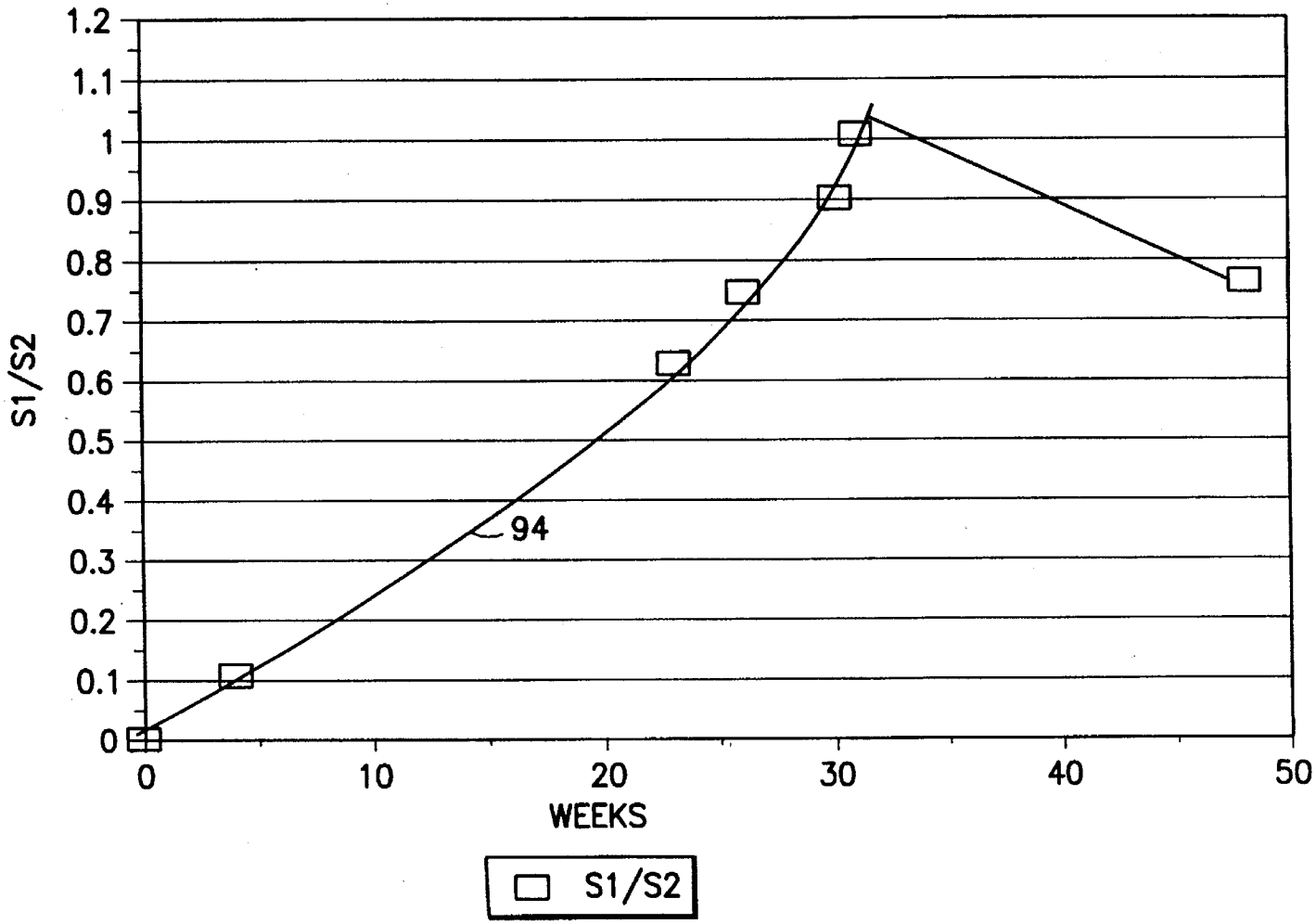
FIG. 20A shows how the ratio S1/S2 can be used to predict refiner plate life.
Figure 20B:
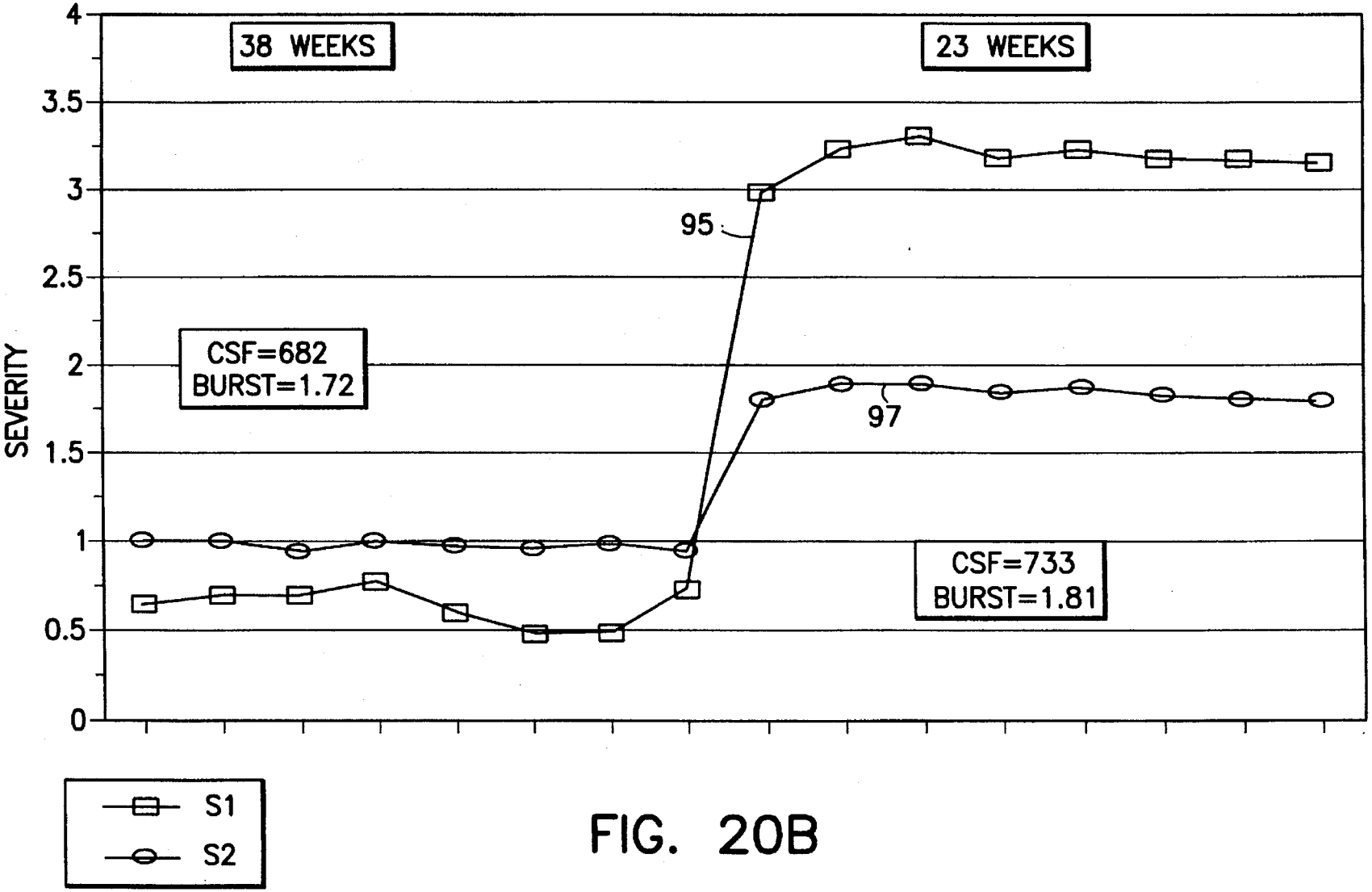
FIG. 20B shows the effect of plate wear, as indicated by the parameter S1/S2, on important pulp properties.

The ratio S1/S2 can also be used to predict refiner plate life, as shown by curve 94 in FIG. 20A. Comparative data of different refiners show that the signal does indicate the presence of plate wear and its effects on pulp properties, e.g., in one case (FIG. 20B) a drop in freeness without an attendant increase in strength. As can be seen from curves 95 and 97, the ratio S1/S2 varies over time, with a dramatic increase in severity indicated by each curve at the point where the plates should be replaced.

Figure 20C:
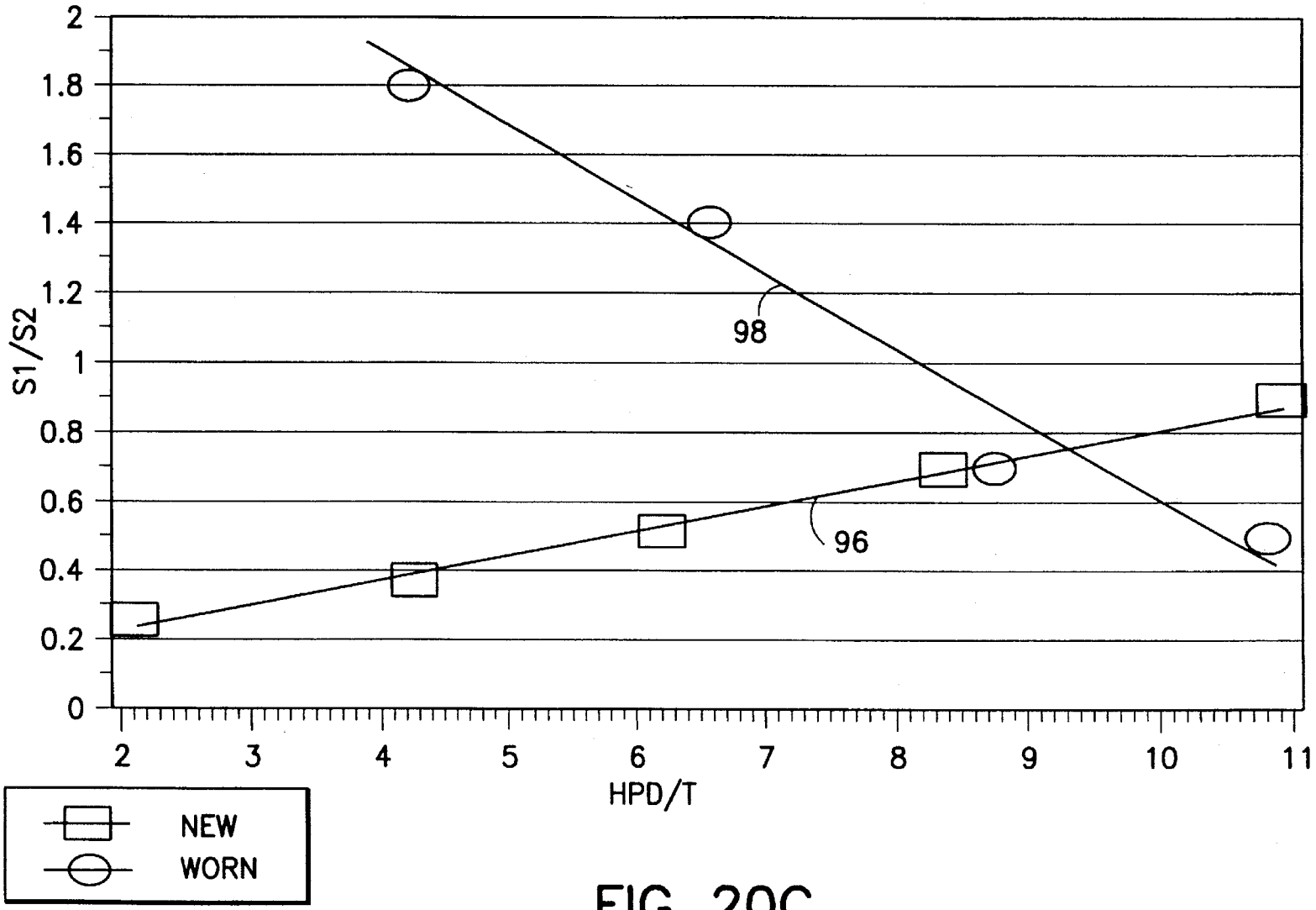
FIG. 20C indicates the effect of plate wear on the parameter S1/S2.

The ability of S1/S2 to indicate plate wear is shown in FIG. 20C. In this example, the same pulp was refined in one refiner with new plates in one trial (curve 96) and worn plates in another (curve 98). The decrease in S1/S2 is clearly shown as it was in FIG. 20A. In this second instance, an increase in tensile strength of ten points was accompanied by a loss in freeness of 160 points for the worn plates and only ninety-five points for the new plates. Those skilled in the art of papermaking will recognize that the greater loss in freeness will require an increase in drying energy on the paper machine and/or reduction in machine speed.

Figure 21:
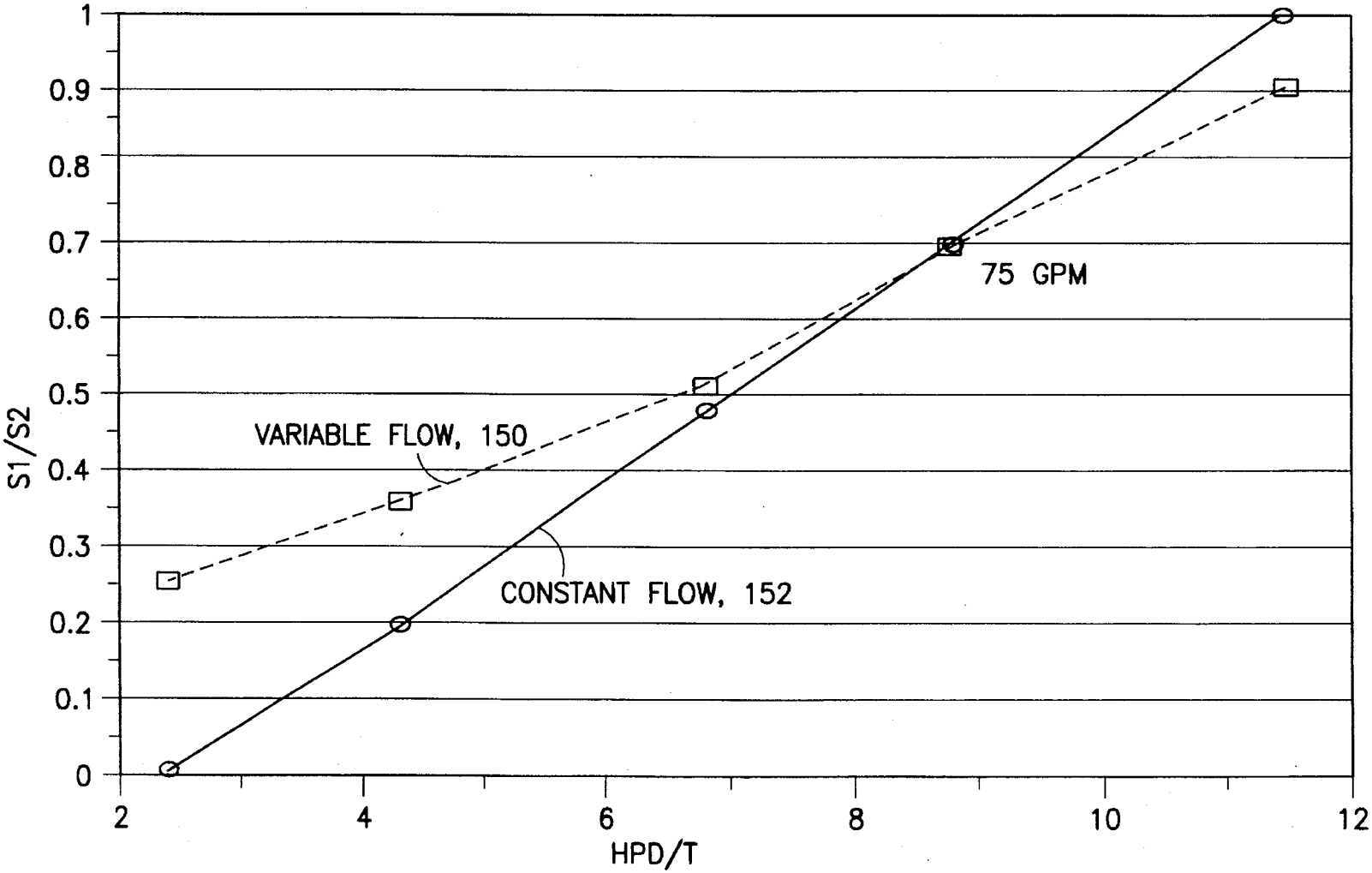

The ratio S1/S2 is also shown plotted vs. HPD/T in FIG. 21. Two curves are shown, one for variable flow (curve 150) and one for constant flow (curve 152). FIG. 21 clearly shows the relationship between the ratio S1/S2 and HPD/T as well as the effect of residence due to flow rate changes. It was found that at the point of coincidence at 75 gpm for these two trials, the LWA and fine contents for the two samples were different. This difference was explained by the relative values of the ratio N1/S1 related to LWA and the ratio N2/S2 related to fines.

Figure 22:
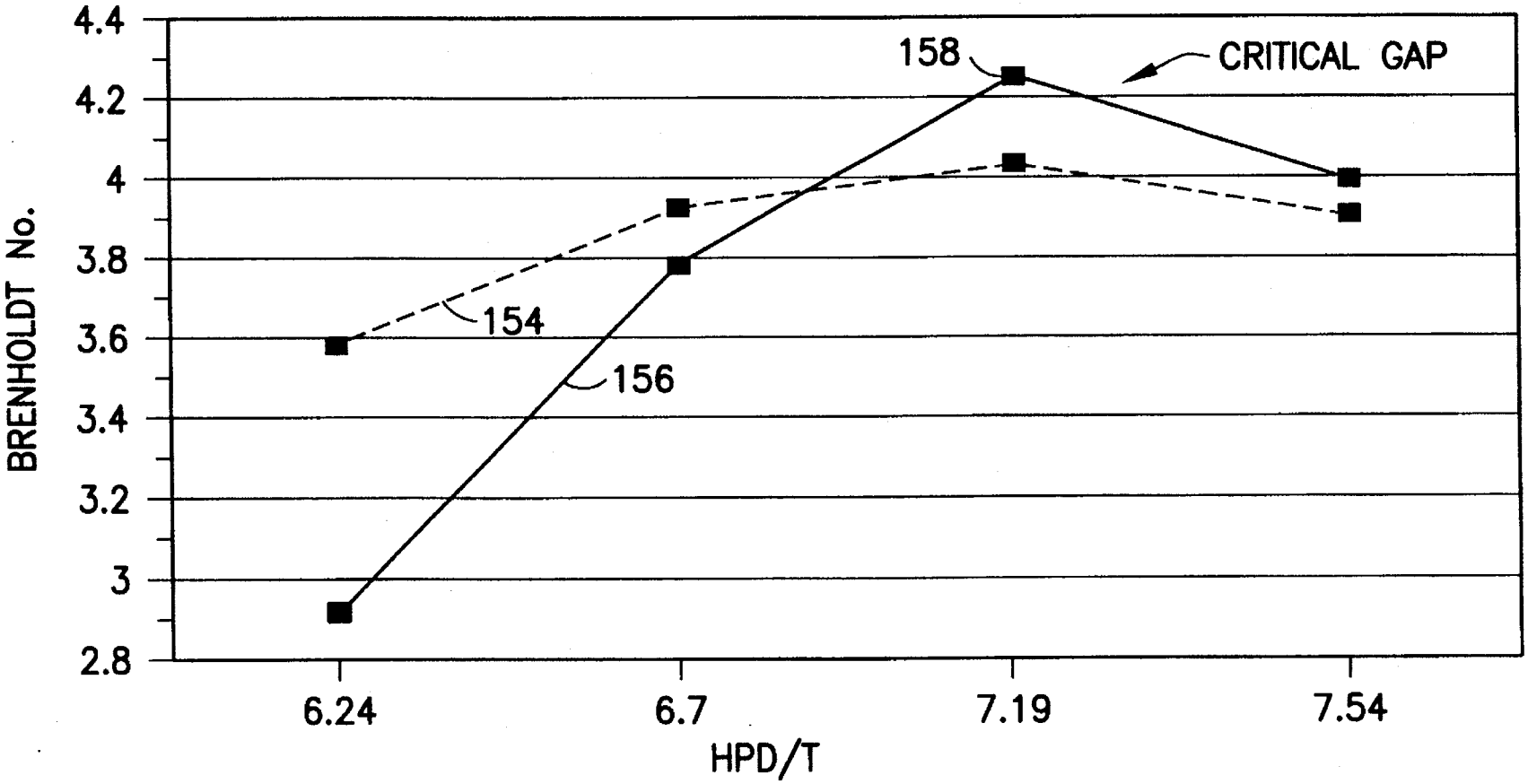

FIG. 22 shows data taken from a pair of refiners operating in series and shows two important characteristics. One is that the parameter S1/S2 (curve 154 for one refiner and curve 156 for the other) is a property of the pulp, which is developed jointly by the two refiners. The second is that when the "critical gap" is reached in a refiner (at some point beyond point 158 in FIG. 22), this parameter (S1/S2) and the pulp quality which it predicts are diminished.

Figure 23:
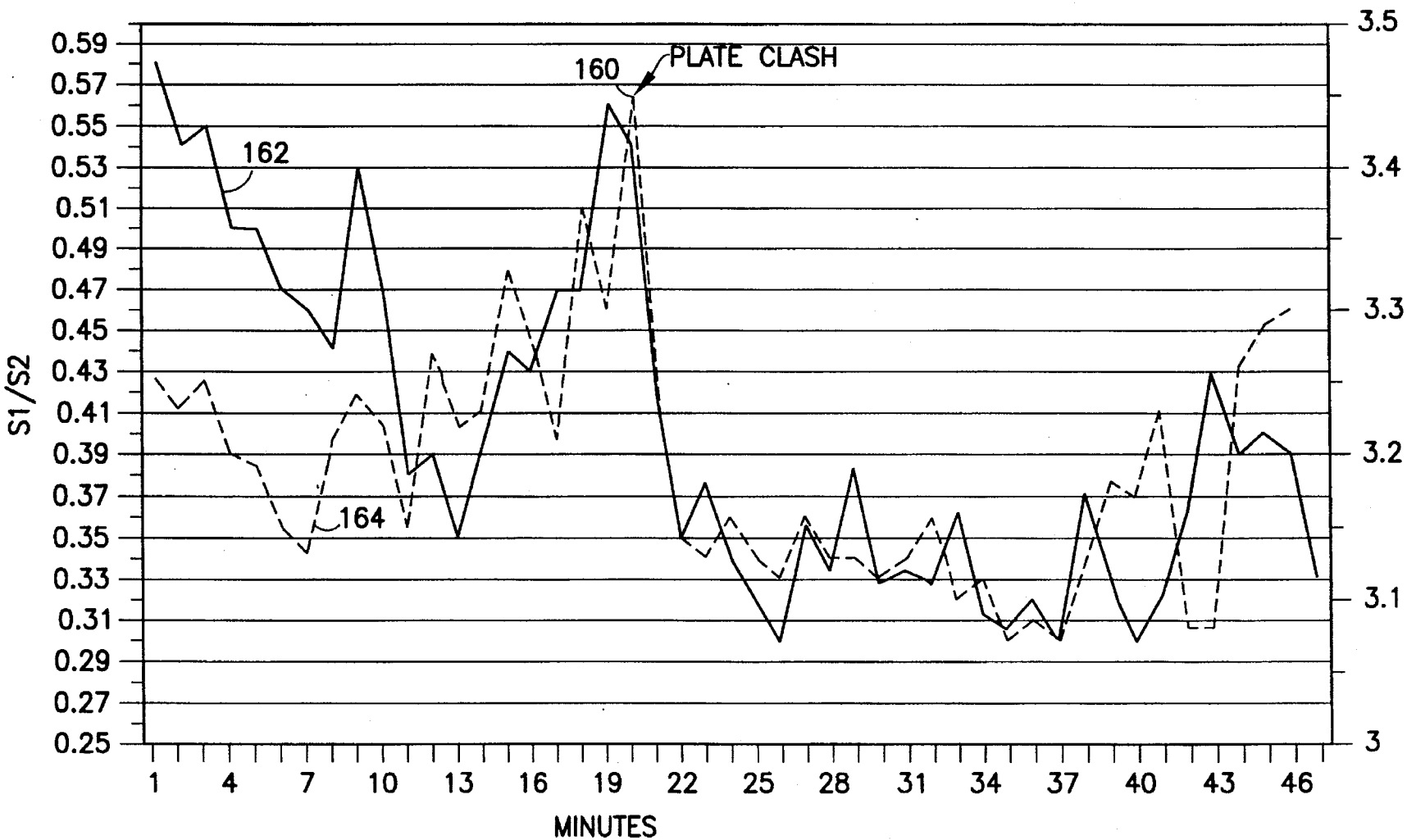

FIG. 23 is indicative of plate clash at peak 160, and the data shows how the parameters S1/S2 (curve 162) and P (curve 164) indicate the occurrence of a critical plate gap. The increase just prior to reaching critical gap is due to the addition of dilution water in order to mitigate any negative consequences of the illustrated trial. These data are further evidence of the sensor's ability to respond to changes in consistency.

Figure 24:
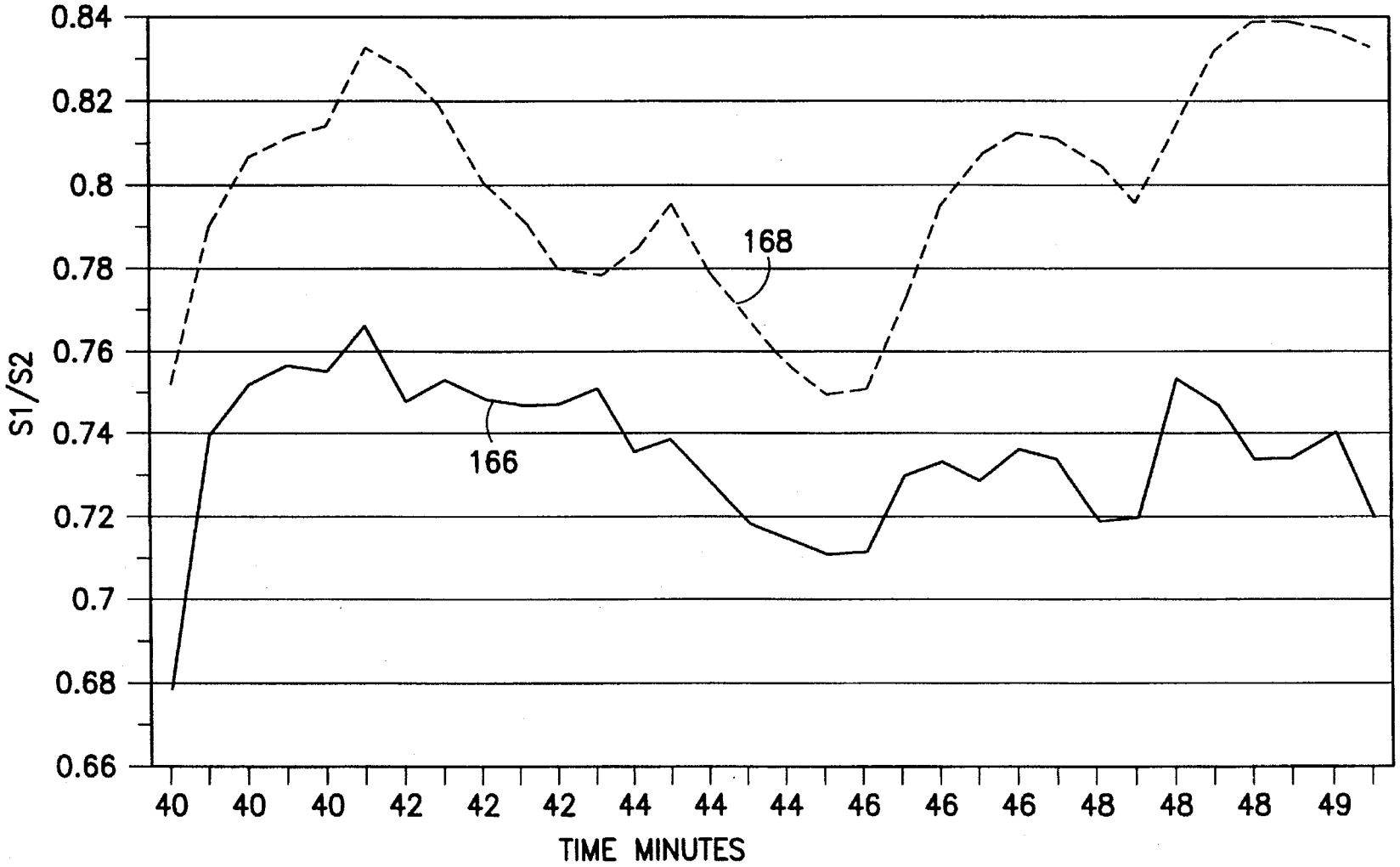
Figure 25:
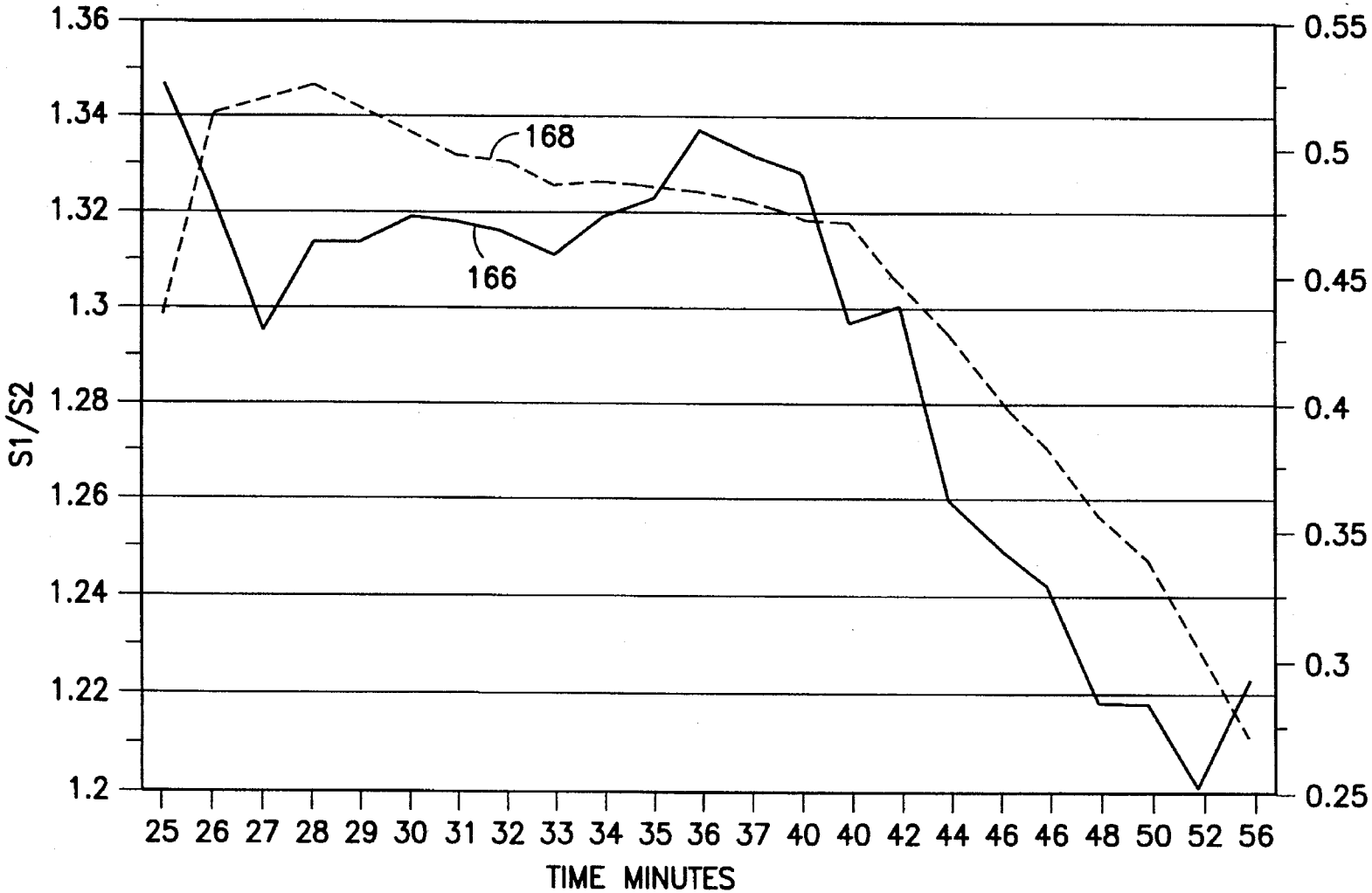

FIGS. 24 and 25 demonstrate the sensor's capability to detect changes in the quality of refiner feed stock. In the example of FIG. 24, the simultaneous response (moving average) of two refiners running in parallel and processing the same feed stock (wood chips) is shown by curves 166 and 168, respectively. Actual wood quality is unknown. The correlation between S1/S2 for the two different refiners is clearly seen, and since the only parameter known to be changing is the feedstock itself, it is apparent that S1/S2 is providing a measure of the feedstock quality. In order to test this conclusion, an experiment was run in which the wood quality was intentionally altered after about 35 minutes by cutting off the steam supply to the surge bin ahead of the refiners. As can be seen from the results plotted for the two refiners in FIG. 25, the ratio S1/S2 drops off substantially after the feedstock was altered, and provides a good indicator of wood quality.

Figure 26:
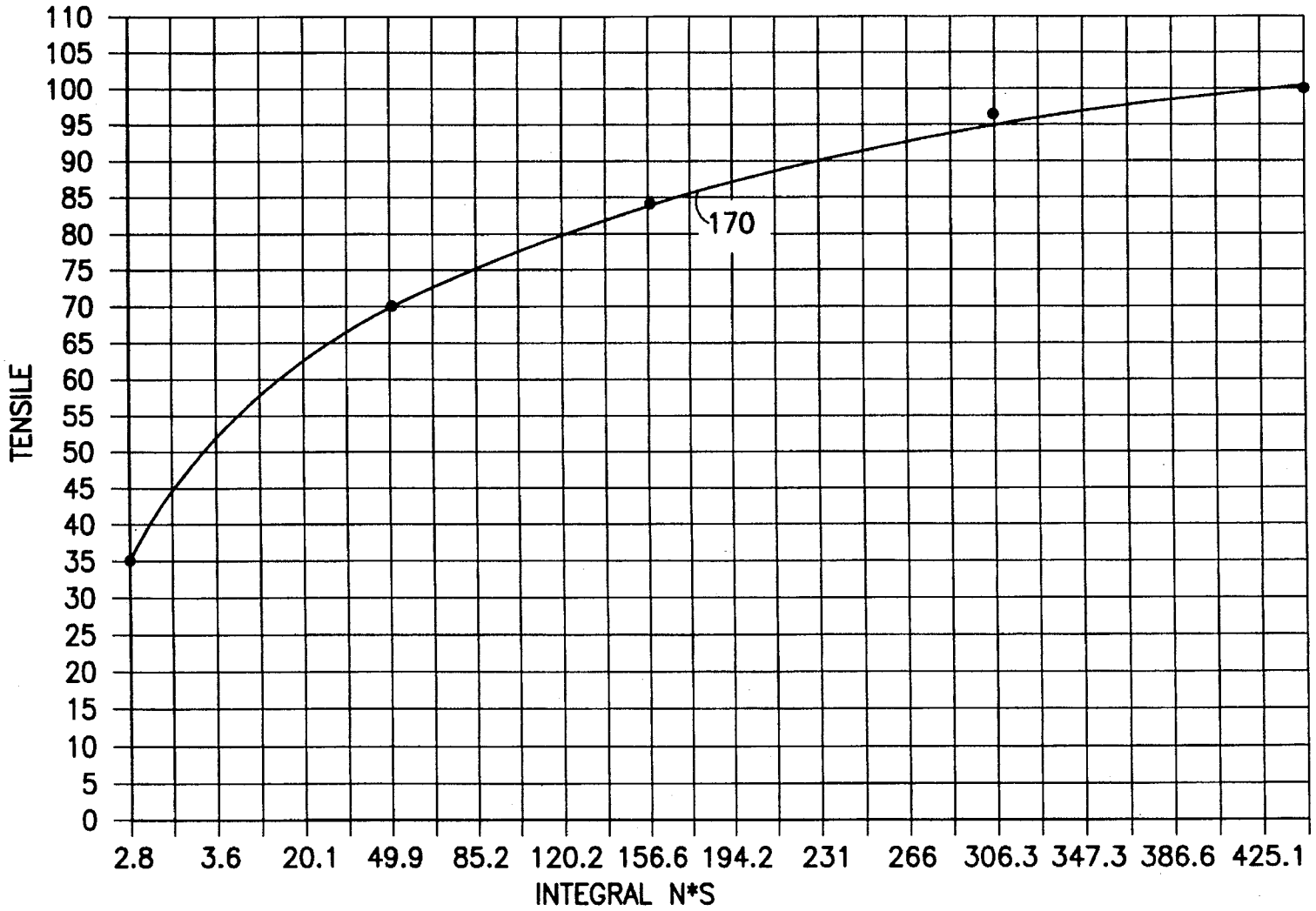

FIG. 26 illustrates data taken from a valley beater, which is a device widely used in the laboratory to examine pulp response to refining. The graph of FIG. 26 (curve 170) shows that the integral of N*S is an excellent predictor of pulp response to refining with respect to a representative example of pulp quality, e.g., tensile strength. Refining theory states that N*S is directly correlated to the energy imparted to the pulp fibers.

Figure 27:
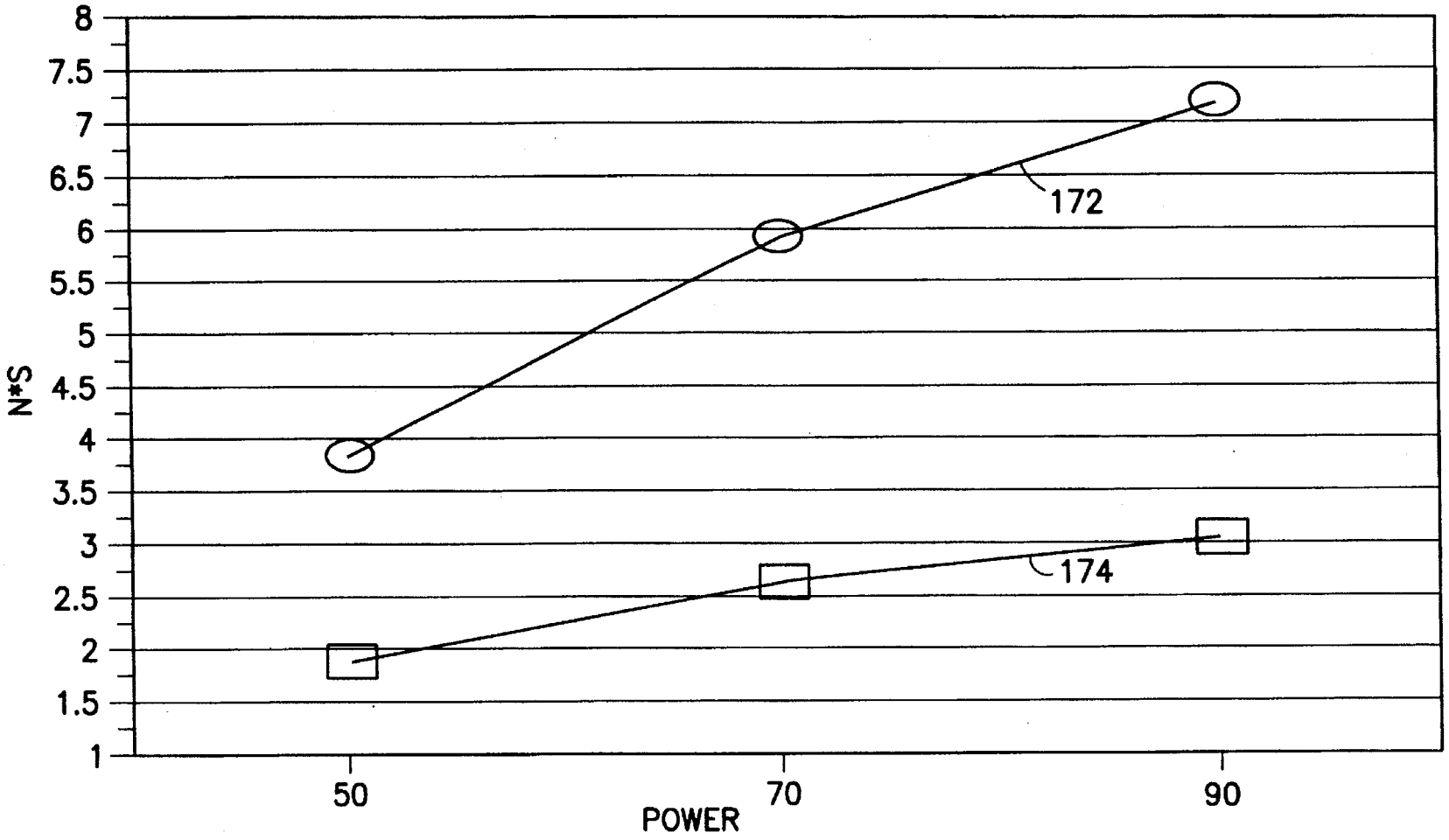
FIG. 27 shows that the product of N*S is proportional to the energy consumed by the refiner in accordance with previously reported theories.

FIG. 27 shows that the product N*S is proportional to the energy (i.e., power) consumed by the refiner. The results of two different refiners are illustrated by curves 172, 174, respectively.

Figure 28:
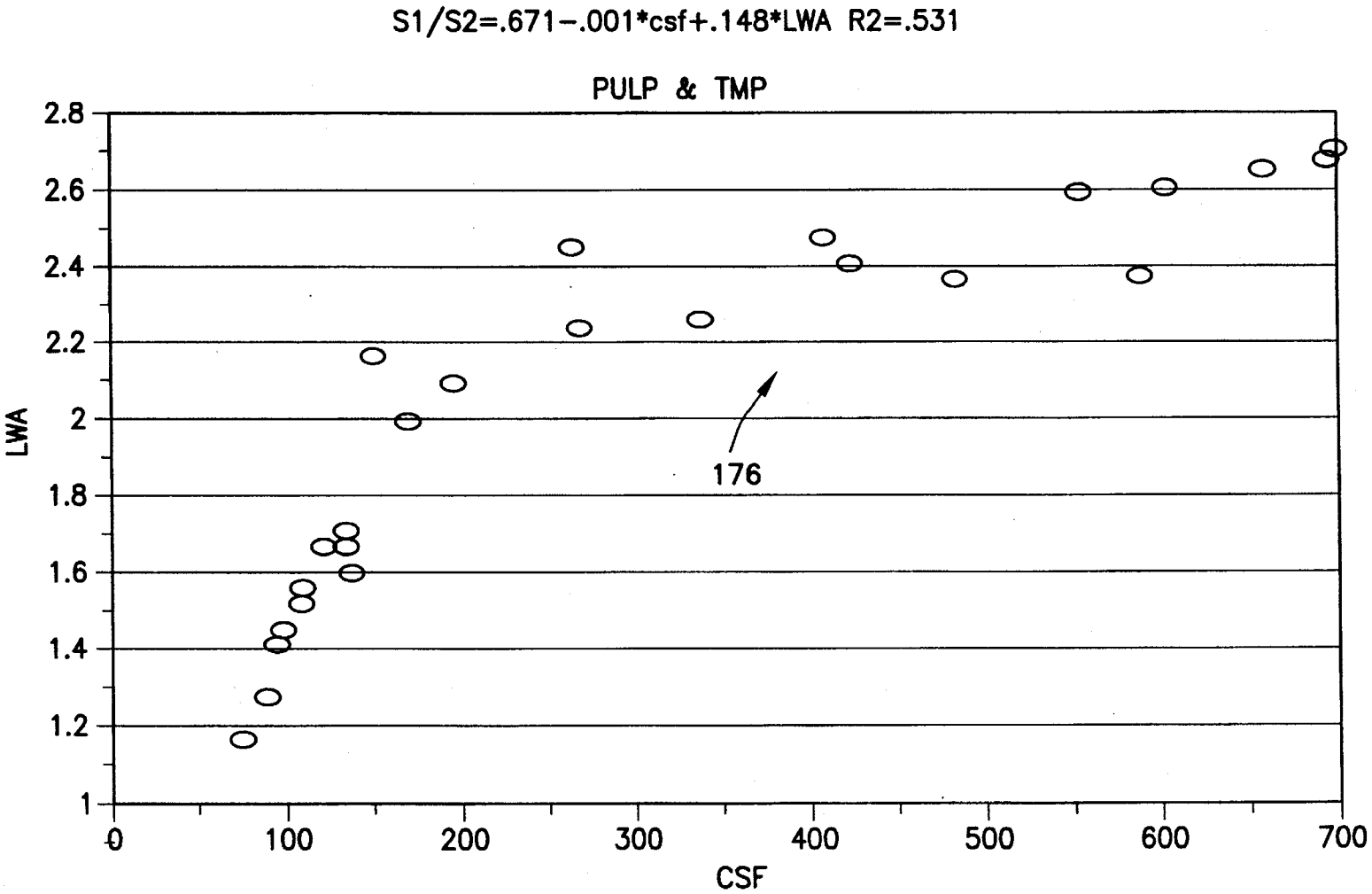
FIG. 28 shows that the parameter S1/S2 is a good indicator of pulp quality as indicated by the two properties CSF and LWA.

FIG. 28 shows that the parameter S1/S2 is a good indicator of pulp quality. The data points generally designated 176 relate to the two properties CSF and LWA.

Figure 29:
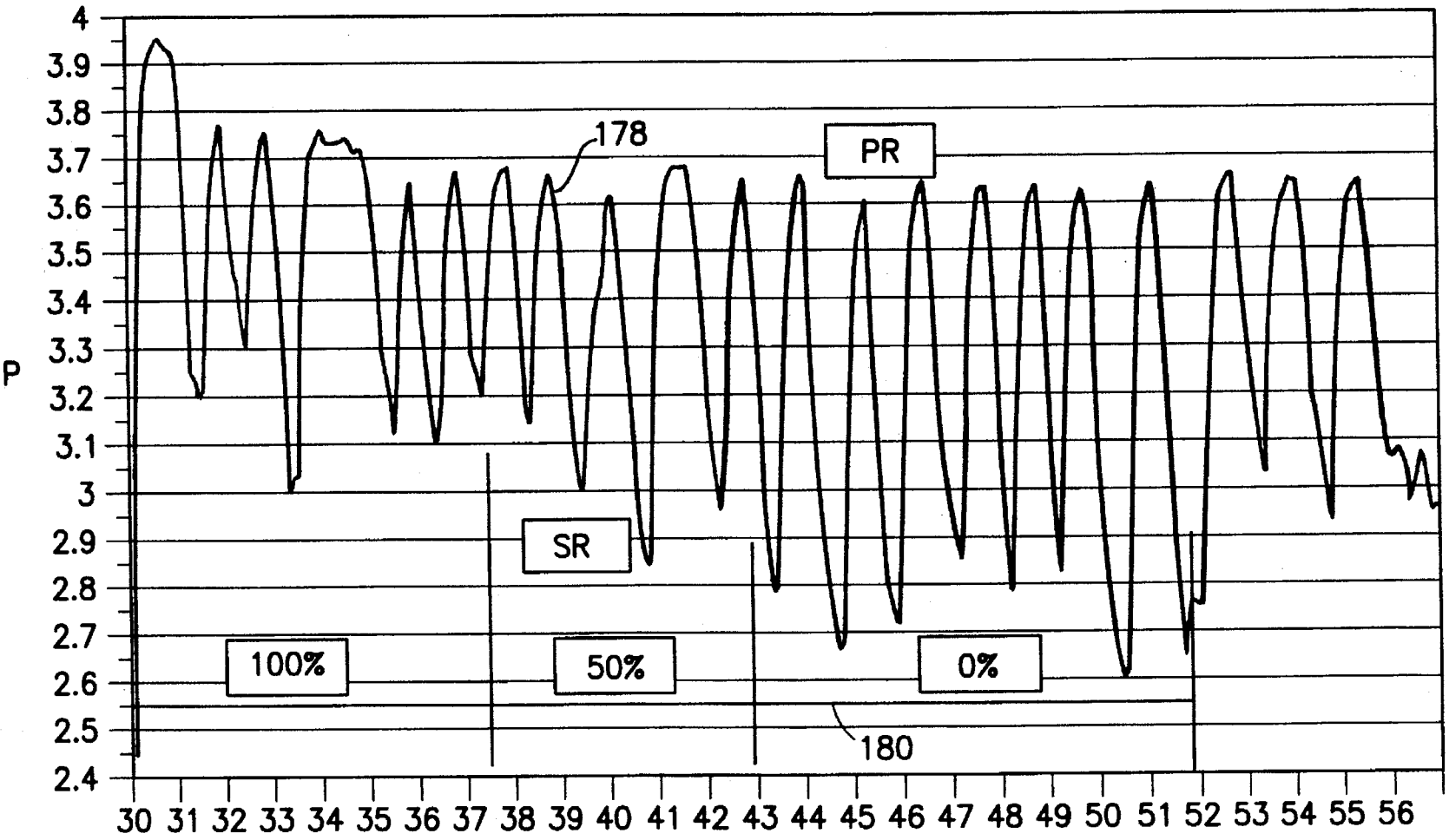
FIG. 29 shows the results of a bleach chemical trial in which the net impact potential (P) is plotted against time for primary (PR) and secondary (SR) refiner stages.

FIG. 29 plots the results of a bleach chemical trial. It is well known that various chemical additives will have an effect on the electrochemistry of pulp slurries. One trial to examine this effect on the net impact potential (P) was conducted by adjusting the rate of addition of a bleaching reagent in the second stage of a two stage refining line. The bleach chemical in this case is a reducing agent. The bleach chemical was reduced in two steps to 50% of normal and then to zero. It was then returned to the 100% level. The P parameter in both the primary (PR) and secondary (SR) stages was recorded. The P value for the primary stage, the input to the secondary stage, was essentially constant during this period (curve 180) while the P value in the secondary stage responded in a consistent manner to the changes in chemical addition (curve 178). This demonstrates that the P parameter will have utility in managing the electrochemistry of pulp slurries, an important aspect of papermaking quality control and economics.

The ratio of N1/S1 has also been shown to correlate well with the long fiber content of the pulp and the ratio N2/S2 with the fines content. This is demonstrated in the following Table 1:

TABLE 1

| | CORRELATION: | |
|---|---|---|
| Millimeters | N1/S1 | N2/S2 |
| 0.10 | 0.19 | 0.41 |
| 1.10 | 0.57 | −0.94 |
| 2.10 | 0.45 | −0.73 |
| 3.10 | 0.82 | −0.90 |
| 4.10 | 0.96 | −0.76 |
| LWA | 0.97 | −0.82 |

It should be realized that numerous other relationships and observations can be made based on the impact sensing of the present invention, and it is not the purpose of the present disclosure to exhaustively document such discoveries or observations. Furthermore, it is beyond the scope and purpose of the present invention to provide a comminution or refining control strategy.

Referring back to FIG. 11, a comminution control strategy block 74 is shown, which strategy may be carried out in software on a microprocessor which provides output control signals, as shown, to the refiner or comminution device, such as shown in FIGS. 1A–1G for control thereof, according to the selected control strategy. While it is beyond the scope of the invention to select or to provide descriptions of all the possible control strategies that may be employed based on the various outputs disclosed herein, those of skill in the art will appreciate that the disclosed sensed signals and processed versions thereof may be readily employed in any number of feedback control systems.

The signal processor that carries out the control strategy may also perform the operations of the mathematical processor 72. In any event, the digital signals shown in FIG. 11 are provided to the controller for carrying out a comminution control strategy. The digital signals are based on the magnitude (i.e., severity, (S)), rate (N), rise time (RT) and polarity (i.e., impact potential, (±P)) signals determined in the various signal processing steps previously described. The characteristics of these parameters, taken separately and/or in mathematical combinations, as shown, can be used to predict exactly the properties of refined wood chips and pulps, i.e., freeness, tensile strength, tear, burst, breaking length and fiber length, which can then be controlled on a real time basis during comminution using a selected control strategy. These signals can also be used for other purposes, for example, tracking refiner plate wear and detecting the occurrence of "critical gap", as well as the onset of plate clash.

As mentioned above, FIGS. 12, 13, 14 and 15 are schematic diagrams of the impact sensor, the impact rate analyzer, the impact severity analyzer and the net potential analyzer of FIG. 11. The function of each has been described. The diagrams provide details of construction and various part numbers which would facilitate construction by anyone skilled in the electronics art.

Similarly, although the invention has been shown and described with respect to a best mode embodiment thereof, it should be understood by those skilled in the art that the foregoing and various other changes, omissions and additions in the form and detail thereof may be made therein without departing from the spirit and scope of the invention as set forth in the claims.

I claim:

1. Apparatus for determining at least one parameter of a material undergoing comminution in a comminution device, comprising:

first coupling means for providing an ohmic connection to a first comminution element of the comminution device;

second coupling means for providing an ohmic connection to a second comminution element of the comminution device; and means coupled to said first and second coupling means for receiving an electrical signal caused by impacts of particles in suspension undergoing comminution between said first and second comminution elements, said receiving means providing an output signal indicative of at least one of the number of impacts and the impact potential of said particles.

2. The apparatus of claim 1, wherein said receiving means comprise circuit means for providing symmetrical common-mode isolation and discrimination of the electrical signal.

3. The apparatus of claim 2 wherein said circuit means comprise:

an isolation transformer having primary windings coupled to said first and second coupling means and secondary windings coupled to a difference amplifier;

a voltage-controlled amplifier coupled to amplify an output of the difference amplifier; and a line driver coupled to receive the amplified output from said voltage-controlled amplifier for providing said output signal.

4. The apparatus of claim 1 wherein said output signal is indicative of the number and severity of impacts of said particles, said apparatus further comprising:

a spectrum divider responsive to said output signal, for providing a plurality of channel output signals each indicative of the number and severity of a different group of said impacts, with said groups segregated according to a rise time of said impacts.

5. The apparatus of claim 4, wherein:

two channel output signals are provided; and said spectrum divider comprises a low pass filter for outputting one of said channel output signals and a high pass filter for outputting the other of said channel output signals.

6. The apparatus of claim 4, wherein said spectrum divider provides a substantially one-to-one relationship of impact severities in the plurality of channel output signals.

7. The apparatus of claim 4, further comprising:

first spectrum analyzer means, responsive to a first one of said channel output signals for providing a first impact rate signal and a first impact severity signal;

second spectrum analyzer means, responsive to a second one of said channel output signals for providing a second impact rate signal and a second impact severity signal; and signal processor means, responsive to said first and second impact rate signals and to said first and second impact severity signals, for processing selected impact rate and severity signals to provide at least one combined signal.

8. The apparatus of claim 7 further comprising a controller, responsive to said at least one combined signal, for providing at least one control signal for controlling said comminution device.

9. The apparatus of claim 7, wherein said at least one combined signal includes a combined signal indicative of a sum or quotient of said first and second severity signals.

10. The apparatus of claim 7, wherein said at least one combined signal includes a combined signal indicative of a sum or quotient of said first and second impact rate signals.

11. The apparatus of claim 7, wherein said at least one combined signal includes a combined signal indicative of a product of one of the impact signals and a corresponding severity signal.

12. The apparatus of claim 7, wherein:

said first spectrum analyzer means are responsive to said first channel output signal for providing a first net impact potential signal;

said second spectrum analyzer means are responsive to said second channel output signal for providing a second net impact potential signal; and said signal processor means are responsive to said first and second net impact potential signals to produce at least one combined signal indicative of the sum or quotient of the first and second net impact potential signals.

13. The apparatus of claim 12 further comprising a controller, responsive to said at least one combined signal, for providing at least one control signal for controlling said comminution device.

14. The apparatus of claim 4, further comprising:

means responsive to said plurality of channel output signals and to a fiber radius signal indicative of the radius of fibers of the material undergoing comminution, for providing a fiber length signal indicative of the length of the fibers for each of the channel output signals.

15. The apparatus of claim 14 further comprising a controller coupled to the fiber length signal for each of the channel output signals to control the operation of the comminution device.

16. A method for determining at least one parameter of a material undergoing comminution in a comminution device, comprising the steps of:

sensing first and second comminution elements of the comminution device to provide an electrical signal indicative of impacts of said material undergoing comminution;

providing, in response to said electrical signal, an output signal indicative of at least one of the number of said impacts and the impact potential; and processing said output signal on a real time basis to predict at least one-property of the material as it is undergoing comminution.

17. The method of claim 16, wherein said processing step includes the steps of:

providing, in response to said output signal, a plurality of channel output signals each indicative of a group of said impacts segregated according to rise time.

18. The method of claim 17, further comprising the steps of:

analyzing said channel output signals to provide corresponding analyzed signals; and mathematically processing said analyzed signals to provide at least one combined signal.

19. The method of claim 18, further comprising the step of providing at least one control signal for controlling said comminution device in response to said at least one combined signal.

20. The method of claim 17 comprising the further step of:

providing, in response to said channel output signals and a fiber radius signal indicative of the radius of the fibers of the material undergoing comminution, a fiber length signal for each of said channel output signals, said fiber length signal being indicative of length of said fibers.

21. The method of claim 20 further comprising the step of providing, in response to said fiber length signal for each of said channel output signals, at least one control signal for controlling said comminution device.

22. The method of claim 16 wherein:

said comminution device is one of a wood chip and pulp refiner; and said output signal is used to predict at least one of freeness, tensile strength, tear, burst, breaking length and fiber length.

23. The method of claim 16, wherein said output signal is used to predict at least one of critical gap and the onset of plate clash in said comminution device.

24. The method of claim 16 wherein said output signal is indicative of the number of impacts, the severity of the impacts, and the impact potential.

* * * * *